US007437109B2

(12) United States Patent
Andoh

(10) Patent No.: US 7,437,109 B2
(45) Date of Patent: Oct. 14, 2008

(54) IMAGE FORMING METHOD AND APPARATUS WITH SENSORS FOR DETECTING AN AMOUNT OF LIGHT WITH RESPECT TO AN ENDLESS MOVING MEMBER

(75) Inventor: Takayuki Andoh, Kanagawa (JP)

(73) Assignee: Ricoh Co., Ltd., Tokyo (JP)

( * ) Notice: Subject to any disclaimer, the term of this patent is extended or adjusted under 35 U.S.C. 154(b) by 199 days.

(21) Appl. No.: 11/451,409

(22) Filed: Jun. 13, 2006

(65) Prior Publication Data

US 2006/0280530 A1 Dec. 14, 2006

(30) Foreign Application Priority Data

Jun. 14, 2005 (JP) ..... 2005-173456

(51) Int. Cl.
*G03G 15/01* (2006.01)

(52) U.S. Cl. ..... 399/301

(58) Field of Classification Search ..... 399/49, 399/107, 301–303

See application file for complete search history.

(56) References Cited

FOREIGN PATENT DOCUMENTS

| | | |
|---|---|---|
| JP | 11-327416 | 11/1999 |
| JP | 2001-100597 | 4/2001 |
| JP | 2002-131997 | 5/2002 |

*Primary Examiner*—Hoang Ngo
(74) *Attorney, Agent, or Firm*—Oblon, Spivak, McClelland, Maier & Neustadt, P.C.

(57) ABSTRACT

An image forming apparatus includes a housing including a cover configured to cover an opening provided in the housing, a transfer unit configured to move a loop-shaped moving member, a portion of which, across an entire width in a direction perpendicular to a moving direction thereof, being exposed through the opening when the cover is opened, and a sensor unit including a holding member configured to hold a plurality of optical sensors arranged in a direction perpendicular to the moving direction of the loop-shaped moving member and configured to detect detecting respective amounts of light at respective areas different from each other on the loop-shaped moving member, end portions of the sensor unit being fixed in the housing at end portions of the opening in a widthwise direction perpendicular to the moving direction of the loop-shaped moving member.

20 Claims, 14 Drawing Sheets

IMAGE FORMING METHOD AND APPARATUS WITH SENSORS FOR DETECTING AN AMOUNT OF LIGHT WITH RESPECT TO AN ENDLESS MOVING MEMBER

CROSS REFERENCE TO RELATED APPLICATIONS

The present application claims priority to Japanese patent application no. 2005-173456, filed in the Japan Patent Office on Jun. 14, 2005, the disclosure of which is incorporated by reference herein in its entirety.

BACKGROUND OF THE INVENTION

1. Field of the Invention

The present invention relates to an image forming apparatus employing an electrophotographic method. More particularly, the present invention relates to an image forming method and apparatus in which optical sensors detect an amount of light with respect to an endless moving member so as to adjust image skew, image shift, misregistration or other variables.

2. Description of the Related Art

Background image forming apparatuses have employed an optical sensor unit to detect optical characteristics of an endless moving member such as an intermediate transfer belt. The optical sensor unit has a holding member that holds a plurality of optical sensors arranged in a direction perpendicular to a moving direction of the endless moving member. The, plurality of optical sensors detect respective amounts of light reflected therefrom or transmitted therethrough at different positions on a surface of the endless moving member. A background image forming apparatus with such optical sensor unit calculates respective amounts of image skew and image shift on the surface of the endless moving member, based on the results of the detection of the optical characteristics.

One background image forming apparatus with the above-described optical sensor unit is well known to have the above-described technique to detect changes in amounts of reflected light on a surface of a transfer belt that serves as an endless moving member with two optical photosensors, one of which is disposed at one end portion in a widthwise direction of the transfer belt and the other of which is disposed at the other end portion in the widthwise direction thereof. Based on the detection result, the background image forming apparatus determines the respective positions of the leading edges of respective toner images transferred at both ends in the widthwise direction of the transfer belt to obtain respective amounts of image skew and image shift of the toner images.

In another background image forming apparatus having a tandem system in which respective toner images of different colors are formed on a plurality of photoconductive drums and are transferred onto a transfer member in an overlaying manner, reference toner images with respective toners of different colors are transferred onto the surface of a transfer belt. That is, the respective toner images plotted by predetermined pixel patterns are transferred onto the transfer belt to be arranged in a widthwise direction of the transfer belt, or in a direction perpendicular to a moving direction of the transfer belt. A plurality of optical sensors are arranged on the surface of the transfer belt along the widthwise direction of the transfer belt so as to detect amounts of adhered toner per unit area with respect to the respective reference toner images. Based on the amount of reflected light obtained by the plurality of optical sensors, the amounts of respective toners to be supplied to respective developing units of the background image forming apparatus are adjusted.

Since the plurality of optical sensors arranged in the widthwise direction of the transfer belt can detect the amounts of respective toners at different positions with respect to the respective reference toner images at the same time, the image forming apparatus with the plurality of optical sensors can perform the replenishing of toner more quickly than an image forming apparatus with a single optical sensor sequentially detecting the amount of toner to be supplied with respect to respective toner images of different colors of toner.

It is important to arrange a plurality of optical sensors with accuracy, along a direction perpendicular to the moving direction of the surface of an endless moving member.

When the plurality of optical sensors are not properly disposed, the amounts of image shift and image skew cannot be accurately detected. Further, when the plurality of optical sensors are not disposed at identical distances with respect to the endless moving member, the proper amounts of toner adhered on the surface of the endless moving member cannot be detected, which may lead to an incorrect adjustment of toner density. Therefore, it is strongly desired that the plurality of optical sensors are accurately disposed at predetermined positions so as to prevent errors in respective relative positions thereof and respective distances thereof with respect to the surface of the endless moving member.

The cause of the above-described errors, however, may depend on the structural layout of the above-described background image forming apparatuses. In maintenance of an image forming apparatus, for example, when a door mounted on a housing of the image forming apparatus is opened, it is difficult for a technical representative to fully perform a visual check of the optical sensors disposed inside the image forming apparatus. More specifically, the technical representative can see one side of a frame or a board holding the optical sensors but cannot see the other side, or simply cannot see the entire frame or board. Therefore, the person needs to take the entire frame or board of the optical sensors out of the image forming apparatus so that he or she can fully check the respective positions of the optical sensors. When the technical representative reattaches the frame or board of the optical sensors to the image forming apparatus after the check has been finished, however, it is difficult to tell that the optical sensors are precisely mounted as they were before the check. If the frame or board has not been positioned with accuracy, the optical sensors may easily be displaced with respect to the endless moving member, and thereby the image shift and image skew can easily be caused.

SUMMARY OF THE INVENTION

Exemplary aspects of the present invention have been made in view of the above-described circumstances.

Exemplary aspects of the present invention provide an image forming apparatus with a plurality of optical sensors accurately disposed without causing a displacement in relative positions with respect to an endless moving member to detect an amount of light with respect to an endless moving member so as to adjust image skew, image shift or misregistration.

Other exemplary aspects of the present invention provide a novel method of disposing an optical sensor unit included in the above-described novel image forming apparatus.

In one exemplary embodiment, an image forming apparatus includes a housing, a transfer unit, and a sensor unit. The housing includes a cover configured to cover an opening provided in the housing. The transfer unit is configured to move a loop-shaped moving member so that a toner image transferred by the transfer unit is conveyed. A portion of the loop-shaped moving member across an entire width in a direction perpendicular to a moving direction thereof is exposed through the opening when the cover is opened. The sensor unit includes a holding member configured to hold a plurality of optical sensors arranged in a direction perpendicular to the moving direction of the loop-shaped moving. The optical sensors detect respective amounts of light at respective areas different from each other on the loop-shaped moving member.

Both end portions of the sensor unit along the arrangement of the plurality of optical sensors are fixed in the housing at both end portions of the opening in a widthwise direction perpendicular to the moving direction of the loop-shaped moving member.

The above-described image forming apparatus may further include a plurality of image bearing members configured to bear respective toner images thereon, and a calculating unit configured to calculate a predetermined variable based on respective results detected by the plurality of optical sensors.

The transfer unit may be configured to move the loop-shaped moving member sequentially facing the plurality of image bearing members so that the respective toner images formed on the plurality of image bearing members are transferred onto a recording medium in one of a direct manner and an indirect manner via the loop-shaped moving member. The housing may be configured to include the plurality of image bearing members, the transfer unit, the sensor unit, and the calculating unit.

The calculating unit may be configured to calculate an amount of image skew as the predetermined variables, based on each of the respective detection results. The image skew may be formed in a direction perpendicular to the moving direction of the loop-shaped moving member with respect to the plurality of toner images transferred onto the loop-shaped moving member.

The calculating unit may be configured to calculate an amount of image shift as one of the predetermined variables or as the only variable, based on each of the respective detection results. The image shift may be formed in the moving direction of the loop-shaped moving member with respect to the plurality of toner images transferred onto the loop-shaped moving member.

The calculating unit may be configured to calculate an amount of attached toner per unit area as a predetermined variable, based on each of the respective detection results.

The housing may be configured to include first and second fixing members. The first fixing member may fix a surface thereof facing the opening of the housing, with one end portion of the holding member in a direction perpendicular to the moving direction of the loop-shaped moving member. The second fixing member may fix a surface thereof facing the opening of the housing, with the other end portion of the holding member.

The opening and the surfaces of the first and second fixing members may respectively extend in a vertical direction.

The holding member may include a first engaging member configured to engage a portion thereof with an upper portion of the first fixing member in the vertical direction of the first fixing member so that the one end portion of the holding member is temporarily engaged between the opening and the surface of the first fixing member facing the opening; and a second engaging member configured to engage a portion thereof with an upper portion of the second fixing member in the vertical direction of the second fixing member so that the other end portion of the holding member is temporarily engaged between the opening and the surface of the second fixing member facing the opening.

The sensor unit may be arranged in a vertical direction at a position above the loop-shaped moving member.

The holding member may include first and second sides of a side plane surface thereof The first and second fixing members may be fixed in close contact with the first side to mount the plurality of optical sensors thereon, and the plurality of optical sensors may be mounted on the second side opposite to the first side thereof.

The plurality of optical sensors may be configured to detect one of an amount of light reflected from the surface of the loop-shaped moving member and an amount of light transmitted through the loop-shaped moving member, by emitting and receiving through at least one window. The holding member may include a shutter configured to open and close the at least one window, and a drive source configured to drive the shutter.

The cover may be configured to fixedly mount a roller rotating while contacting the loop-shaped moving member. The recording medium may be conveyed between the loop-shaped moving member and the roller. The holding member may be configured to hold the plurality of optical sensors between the opening and the drive source and fixedly mount the drive source thereon.

Further, in one exemplary embodiment, a method of disposing a plurality of optical sensors in a housing of an image forming apparatus includes forming an opening extending across an entire width of the housing, in a direction perpendicular to a moving direction of a loop-shaped moving member in the housing, providing first and second fixing members in the housing, mounting first and second engaging members on a holding member holding the plurality of optical sensors thereon, temporarily engaging the first and second engaging members with the first and second fixing members, respectively, and positioning the holding member with the housing.

The method may further include mounting a shutter on the holding member to open and close at least one window for emitting and receiving light therethrough so that the plurality of optical sensors detect one of an amount of light reflected from a surface of the loop-shaped moving member and an amount of light transmitted through the loop-shaped moving member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
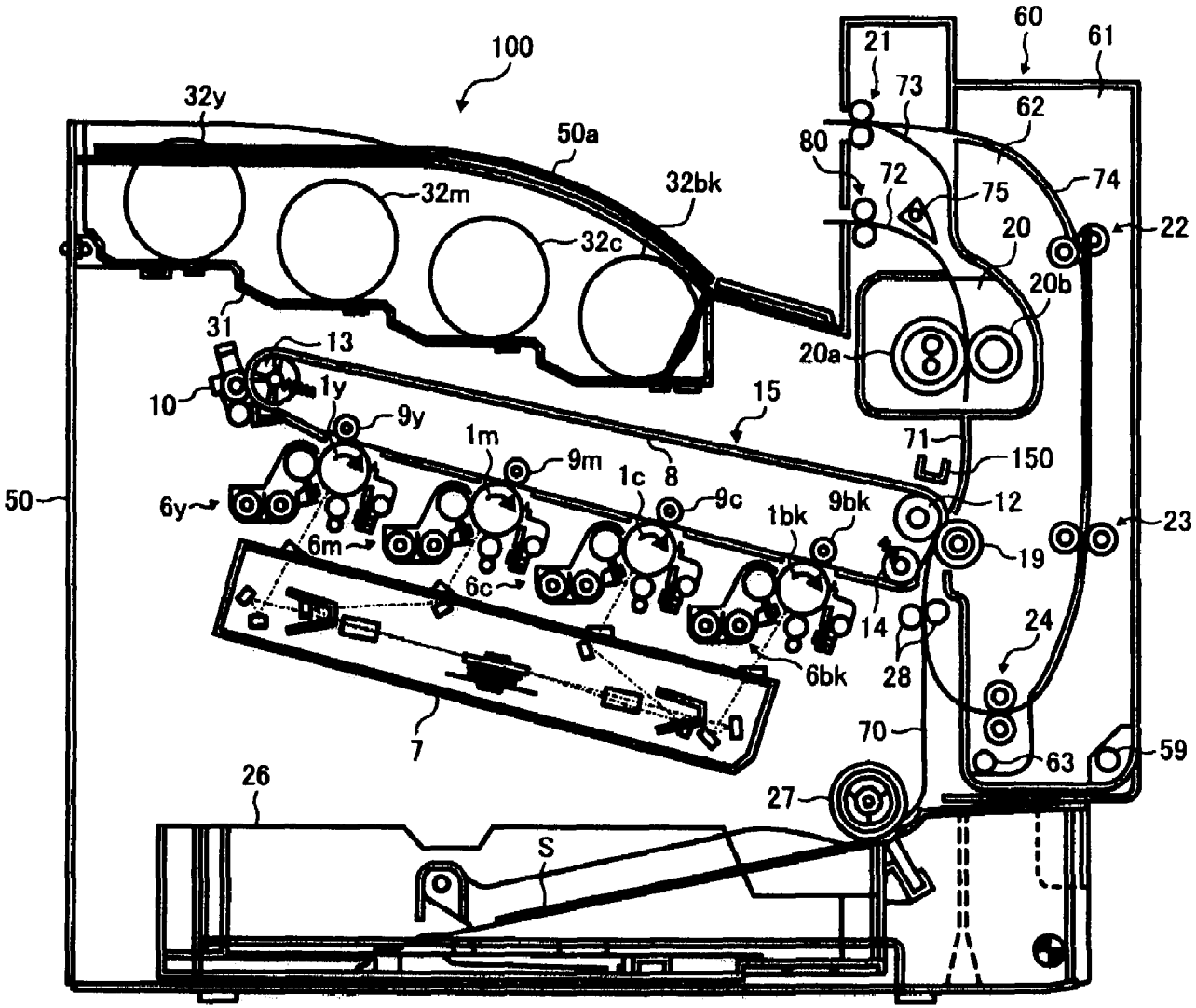
FIG. 1 is a cross sectional view of a schematic structure of an image forming apparatus according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 2:
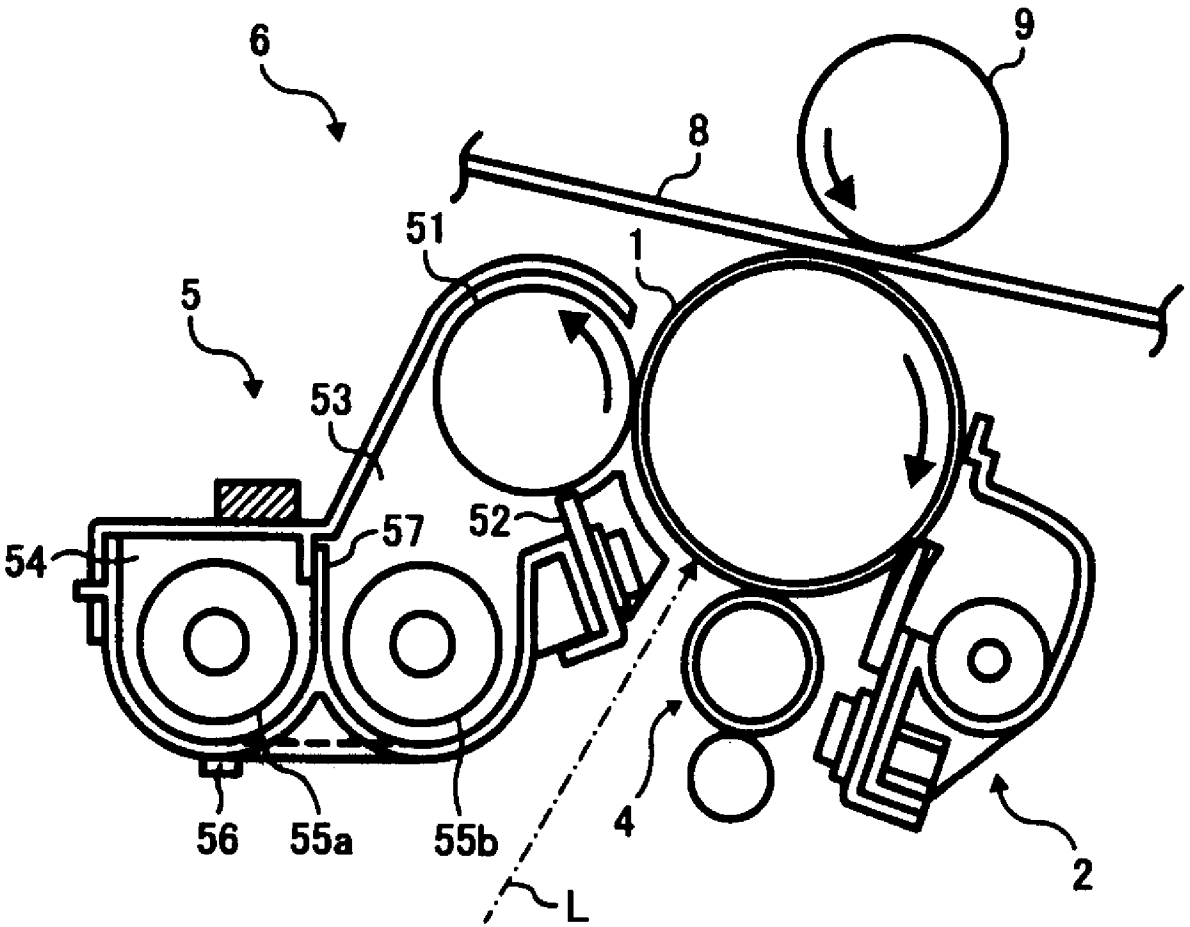
FIG. 2 is an enlarged cross sectional view of a process cartridge and image forming components in the vicinity of the process cartridge of the image forming apparatus of FIG. 1, according to the exemplary embodiment of the present invention.

Referring to FIGS. 1 and 2, a schematic structure of a printer 100 serving as an image forming apparatus according to an exemplary embodiment of the present invention is described.

The printer 100 shown in FIG. 1 includes four process cartridges 6*y*, 6*c*, 6*m* and 6*bk* as an image forming mechanism, four toner bottles 32*y*, 32*c*, 32*m* and 32*bk* as a toner feeding mechanism, an optical writing unit 7, a transfer unit 15 as a transfer mechanism, a sheet feeding cassette 26 as a sheet feeding mechanism, and a fixing unit 20 as a fixing mechanism. The above-described mechanisms are included in a housing 50 of the printer 100.

The housing 50 also includes an optical sensor unit 150 at a position between the intermediate transfer belt 8 and the fixing unit 20. Details of the optical sensor unit 150 will be described later.

The process cartridges 6*y*, 6*c*, 6*m* and 6*bk* include respective consumable image forming components to perform image forming operations for producing respective toner images with toners of different colors of yellow (y), cyan (c), magenta (m), and black (bk). The process cartridges 6*y*, 6*c*, 6*m* and 6*bk* are separately arranged at positions having different heights in a stepped manner and are detachably provided to the printer 100 so that each of the process cartridges 6*y*, 6*c*, 6*m* and 6*bk* can be replaced once at an end of its useful life. Since the four process cartridges 6*y*, 6*c*, 6*m* and 6*bk* have similar structures and functions, except that respective toners are of different colors, which are yellow, cyan, magenta and black toners, the discussion below uses reference numerals for specifying components of the printer 100 without suffixes of colors such as y, c, m and bk.

FIG. 2 shows an enlarged view of a process cartridge 6 for producing a single color toner image.

The process cartridge 6 has image forming components around it. The image forming components included in the process cartridge 6 are a photoconductive drum 1, a drum cleaning unit 2, a diselectrifying or discharging unit (not shown), a charging unit 4, a developing unit 5, and so forth.

The photoconductive drum 1 is a rotating member including a cylindrical conductive body having a relatively thin base. In the printer 100 according to the exemplary embodiment of the present invention, a drum type image bearing member such as the photoconductive drum 1 is used. However, as an alternative, a belt type image bearing member may be applied as well.

The drum cleaning unit 2 removes residual toner remaining on the surface of the photoconductive drum 1.

The charging unit 4 including a charging roller (not shown) is applied with a charged voltage. When the photoconductive drum 1 is driven by a rotation drive unit (not shown) as a rotation drive mechanism, and is rotated clockwise in FIG. 2, the charging unit 4 applies the charged voltage to the photoconductive drum 1 to uniformly charge the surface of the photoconductive drum 1 to a predetermined polarity.

The developing unit 5 of FIG. 2 develops the electrostatic latent image formed on the surface of the photoconductive drum 1 into a single color toner image. Thus, the toner image is formed on the surface of the photoconductive drum 1.

The developing unit 5 includes a developing roller 51, a doctor blade 52, a first supplying portion 53, a second supplying portion 54, first and second toner conveying screws 55*a* and 55*b*, a toner density sensor 56, and a dividing plate 57.

The developing roller 51 is disposed in the developing unit 5 to cause a portion of the developing roller 51 to be exposed from an opening of a casing of the developing unit 5.

The first and second toner conveying screws 55*a* and 55*b* are disposed in parallel with each other in the developing unit 5.

The casing of the developing unit 5 includes developer (not shown). The developer includes a magnetic carrier and a single color toner corresponding to the image data. The developer is frictionally charged to a predetermined polarity while being agitated by the first and second toner conveying screws 55*a* and 55*b*. The developer is then conveyed onto the surface of the developing roller 51. The doctor blade 52 regulates the developer conveyed to the surface of the developing roller 51 to a predetermined thickness or height so that the regulated developer can be conveyed to a developing area located opposite to the photoconductive drum 1. At this time, toner included in the developer is transferred onto an electrostatic latent image formed on the surface of the photoconductive drum 1 according to the image data. The above-described transfer of toner is used to form a single color toner image on the surface of the photoconductive drum 1. The developer remaining on the developing roller 51 is conveyed back to the casing of the developing unit 5 as the developing roller 51 rotates.

The dividing plate 57 is disposed between the first and second toner conveying screws 55*a* and 55*b* so as to divide the developing unit 5 into the first and second supplying portions 53 and 54. The first supplying portion 53 accommodates the developing roller 51 and the second toner conveying screw 55*b*.

The second supplying portion 54 accommodates the first toner conveying screw 55*a*. The second toner conveying screw 55*b* is driven by a drive unit (not shown) to supply the developer to the developing roller 51 while the developer in the first supplying portion 53 is conveyed from the front side to the rear side in a longitudinal direction of the first supplying portion 53. The developer conveyed by the second toner conveying screw 55*b* to the vicinity of the far end portion of the first supplying portion 53 is further conveyed through an opening (not shown) of the dividing plate 57 into the second supplying portion 54. In the second supplying portion 54, the first toner conveying screw 55*a* is driven by a drive unit (not shown) to convey the developer conveyed from the first supplying portion 53 to the direction opposite to the second toner conveying screw 55*b*. That is, the developer in the second supplying portion 54 is conveyed from the rear side to the front side in a longitudinal direction of the second supplying portion 54 of the developing unit 5 of the printer 100. The developer conveyed by the first toner conveying screw 55*a* to the vicinity of the near end portion of the second supplying portion 54 is further conveyed through a different opening (not shown) of the dividing plate 57 back into the first supplying portion 53.

The toner density sensor 56 is hereinafter referred to as a "T-sensor". The T-sensor 56 is a permeability sensor and is disposed on an outside of the bottom plate of the second supplying portion 54 so as to output a voltage of a value according to a permeability of the developer passing above the T-sensor 56. Since the permeability of a two-component developer including toner and magnetic carrier has a preferable correlation with a toner density, the T-sensor 56 can output a voltage according to the toner density of the corresponding color of toner. The value of the output voltage is sent to a control unit 200 that is shown later in FIG. 6.

The control unit 200 includes a random access memory (RAM) storing a target value Vtref of the corresponding color of the output voltage from the T-sensor 56. The RAM includes respective target values Vtref for yellow, magenta, cyan, and black toners of the output voltages from the respective T-sensors 56 mounted on the respective developing units 5.

For example, the target value Vtref for yellow toner may be used to control a yellow toner conveying unit (not shown). More specifically, the control unit 200 controls the yellow toner conveying unit to supply the yellow toner in the second supplying portion 54. The output voltage from the T-sensor 56 is determined by the amount of the corresponding toner detected, and toner is continuously supplied until the output voltage matches the target value Vtref. The replenishment of toner can maintain the toner density in the developer at a predetermined level. The above-described operation is identical for the magenta, cyan, and black toners.

As shown in FIG. 1, the four toner bottles 32*y*, 32*c*, 32*m* and 32*bk* independently detachable from each other are arranged at a position between the transfer unit 15 and a stacker 50a and are supported by a bottle supporting portion 31. The toner bottles 32*y*, 32*c*, 32*m* and 32*bk* are also separately provided with respect to the respective process cartridges 6*y*, 6*c*, 6*m* and 6*bk*, and are detachably arranged to the printer 100. With the above-described structure, each toner bottle may easily be replaced with a new toner bottle when the toner bottle is detected as being in a toner empty state, for example.

The optical writing unit 7 of FIG. 1 is a part of the image forming mechanism, and emits four laser light beams towards the photoconductive drums 1*y*, 1*c*, 1*m* and 1*bk*. When the optical writing unit 7 emits a laser light beam L toward the photoconductive drum 1 of the process cartridge 6 in FIGS. 1 and 2, the laser light beam L is deflected by a polygon mirror (not shown) that is also driven by a motor. The laser light beam L travels via a plurality of optical lenses and mirrors, and reaches the photoconductive drum 1. The process cartridge 6 receives the laser light beam L, which is optically modulated. The laser light beam L, according to image data corresponding to a color of toner for the process cartridge 6, irradiates a surface of the photoconductive drum 1 through a path formed between the charging unit 4 and the developing unit 5, so that an electrostatic latent image is formed on the charged surface of the photoconductive drum 1.

In FIG. 1, the transfer unit 15 is arranged above the process cartridges 6*y*, 6*c*, 6*m* and 6*bk*. The transfer unit 15 includes an intermediate transfer belt 8, a belt cleaning unit 10, four primary transfer bias rollers 9*y*, 9*c*, 9*m* and 9*bk*, a secondary transfer backup roller 12, a cleaning backup roller 13, and a tension roller 14. The intermediate transfer belt 8 forms an endless belt spanned around or extending over the secondary transfer backup roller 12, the cleaning backup roller 13 and the tension roller 14, and rotates counterclockwise in FIG. 1. The intermediate transfer belt 8 is held in contact with the primary transfer bias rollers 9*y*, 9*c*, 9*m* and 9*bk* corresponding to the photoconductive drums 1*y*, 1*c*, 1*m* and 1*bk*, respectively, to form respective primary transfer nips between the photoconductive drum 1*y* and the primary transfer roller 9*y*, between the photoconductive drum 1*c* and the primary transfer roller 9*c*, and so forth.

Corresponding to the photoconductive drum 1 of FIG. 2, the primary transfer bias roller 9 is arranged at a position opposite to the photoconductive drum 1. With the above-described structure, the toner image formed on the surface of the photoconductive drum 1 can be transferred onto the intermediate transfer belt 8.

The primary transfer bias roller 9 receives a transfer voltage having an opposite polarity to the charged toner to transfer the transfer voltage to an inside surface of the intermediate transfer belt 8. For example, when the charged toner is applied to a negative polarity, the primary transfer bias roller 9 receives the transfer voltage with a positive polarity. The rollers except the primary transfer bias roller 9 are grounded.

Through operations similar to those as described above, yellow, cyan, magenta and black images are formed on the surfaces of the respective photoconductive drums 1*y*, 1*c*, 1*m* and 1*bk*. Those color toner images are sequentially overlaid on the surface of the intermediate transfer belt 8, such that a primary overlaid toner image is formed on the surface of the intermediate transfer belt 8. Hereinafter, the primary overlaid toner image is referred to as a four color toner image.

The transfer unit 15 also includes a separation mechanism (not shown) to separate the intermediate transfer belt 8 from the photoconductive drums 1*y*, 1*c* and 1*m* while the intermediate transfer belt 8 is continuously held in contact with the photoconductive drum 1*bk*. The separation mechanism is used when the printer 100 performs an image forming operation for producing a black-and-white image.

After the toner image formed on the surface of the photoconductive drum 1 is transferred onto the surface of the intermediate transfer belt 8, the drum cleaning unit 2 removes residual toner on the surface of the photoconductive drum 1. Further, the diselectrifying unit removes the charges remaining on the surface of the photoconductive drum 1 so that the photoconductive drum 1 can be ready for the next operation.

In FIG. 1, the sheet feeding cassette 26 accommodates a plurality of recording media such as transfer sheets that include an individual transfer sheet S that serves as a recording medium. The sheet feeding mechanism also includes a sheet feeding roller 27 and a pair of registration rollers 28. The sheet feeding roller 27 is held in contact with the transfer sheet S. The sheet feeding roller 27 is rotated by a roller drive motor (not shown), the *transfer sheet S placed on the top of a stack of transfer sheets in the sheet feeding cassette 26 is fed into a sheet conveying path 70 and is conveyed to a portion between rollers of the pair of registration rollers 28. The pair of registration rollers 28 stops and feeds the transfer sheet S in synchronization with a movement of the four color toner image towards a secondary transfer area, which is a secondary nip portion formed between the intermediate transfer belt 8 and a secondary transfer bias roller 19.

The secondary transfer bias roller 19 is applied with an adequate predetermined transfer voltage so that the four color toner image formed on the surface of the intermediate transfer belt 8 is transferred onto the transfer sheet S. The four color toner image transferred on the transfer sheet S is referred to as a full color toner image.

The belt cleaning unit 10 removes residual toner adhering on the surface of the intermediate transfer belt 8.

The transfer sheet S that has the full color toner image thereon is conveyed further upward via a post-transfer sheet conveying path 71, and passes between a pair of fixing rollers of the fixing unit 20.

The fixing unit 20 is detachable with respect to the housing 50 and includes a heat roller 20*a* having a heater therein, for example a halogen lamp, and a pressure roller 20*b* for pressing the transfer sheet S for fixing the four color toner image. The fixing unit 20 fixes the four color toner image to the transfer sheet S by applying heat and pressure.

After passing the fixing unit 20, the transfer sheet S is discharged by a sheet discharging roller 29 to a sheet discharging tray 50 provided at the upper portion of the printer 100.

The transfer sheet S that passed the fixing unit 20 comes to a branching point of a sheet discharging path 72 and a pre-reverse sheet conveying path 73. A switching pawl 75 is swingablly (pivotably) disposed at the branching point so that the swing of the switching pawl 75 can select either path for the transfer sheet S to forward. More specifically, when the tip of the switching pawl 75 is moved toward the pre-reverse sheet conveying path 73, the transfer sheet S is conveyed to the sheet discharging path 72. On the other hand, when the tip of the switching pawl 75 is moved away from the pre-reverse sheet conveying path 73, the transfer sheet S is conveyed to the pre-reverse sheet conveying path 73.

When the switching pawl 75 has selected the direction to guide the transfer sheet S to the sheet discharging path 72, the transfer sheet S is conveyed through the sheet discharging path 72 and a pair of sheet discharging rollers 80, and is discharged and stacked on the stacker 50*a* on the top of the housing 50 of the printer 100.

When the switching pawl 75 has selected the direction to guide the transfer sheet S to the pre-reverse sheet conveying path 73, the transfer sheet S is conveyed through the pre-reverse sheet conveying path 73 and comes to the nip of a pair of reverse rollers 21. The pair of reverse rollers 21 feeds the transfer sheet S toward the stacker 50*a*, stops immediately before the trailing edge of the transfer sheet S passes the nip of the pair of reverse rollers 21, and reverses the rotation thereof. The reverse of rotation of the pair of reverse rollers 21 conveys the transfer sheet S in the opposite direction so as to cause the leading edge of the transfer sheet S to enter into a reverse sheet conveying path 74.

The reverse sheet conveying path 74 is included in a cover 60, which will be shown later, and is formed in a bow shape and extends downwardly in a vertical direction. The reverse sheet conveying path 74 includes a first pair of reverse conveying rollers 22, a second pair of reverse conveying rollers 23, and a third pair of reverse conveying rollers 24 therein. The transfer sheet S is vertically reversed by sequentially passing through the nips of the first, second, and third pairs of reverse conveying rollers 22, 23, and 24. The vertically reversed transfer sheet S returns to the sheet conveying path 70, and comes to the secondary transfer nip again. At this time, the transfer sheet S is forwarded to the secondary transfer nip while contacting the other side having no image thereon with the surface of the intermediate transfer belt 8 so that the second four toner images formed on the intermediate transfer belt 8 can be transferred onto the other side of the transfer sheet S. The transfer sheet S is conveyed via the post-transfer sheet conveying path 71, the fixing unit 20, the sheet discharging path 72, and the pair of sheet discharging rollers 80, and is discharged to the stacker 50*a*. With the above-described reverse operation with respect to the transfer sheet S, the full color images are formed on both sides of the transfer sheet S.

Referring to FIGS. 1, 3, 4, and 5, a schematic structure of the cover 60 mounted on the printer 100 according to the exemplary embodiment of the present invention is described.

The cover 60 is pivotably movable and includes an external cover plate 61 and a pivotable supporting member 62.

The external cover plate 61 is mounted on the right side of the printer 100 of FIG. 1 and pivotably moves about a first rotating shaft 59 provided in the housing 50 of the printer 100 so that the external cover plate 61 can open and close an opening (not shown) formed on the housing 50.

Figure 3:
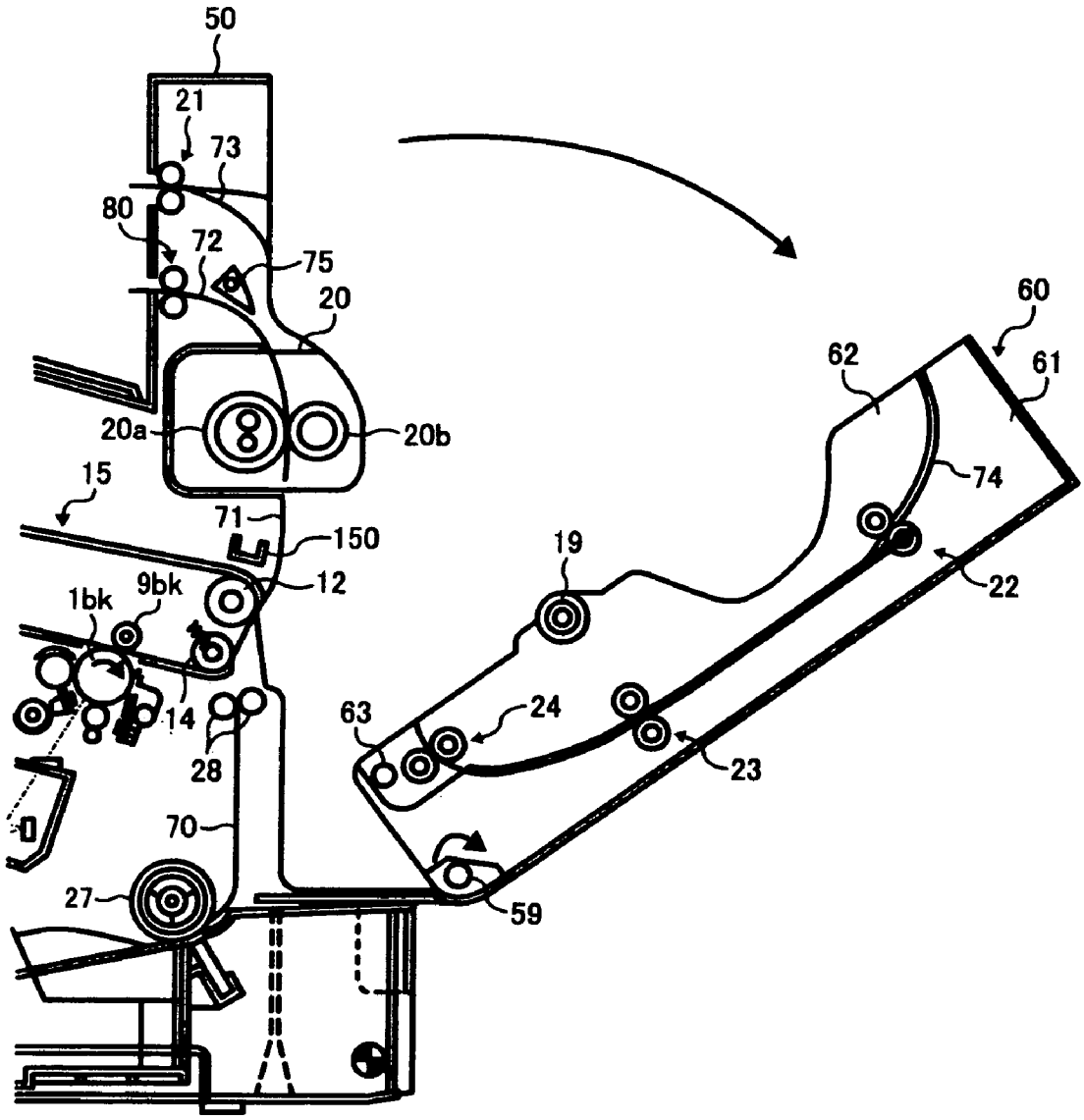
FIG. 3 is a cross sectional view of the image forming apparatus according to the exemplary embodiment of the present invention, when a cover thereof is in an open position.
Figure 4:
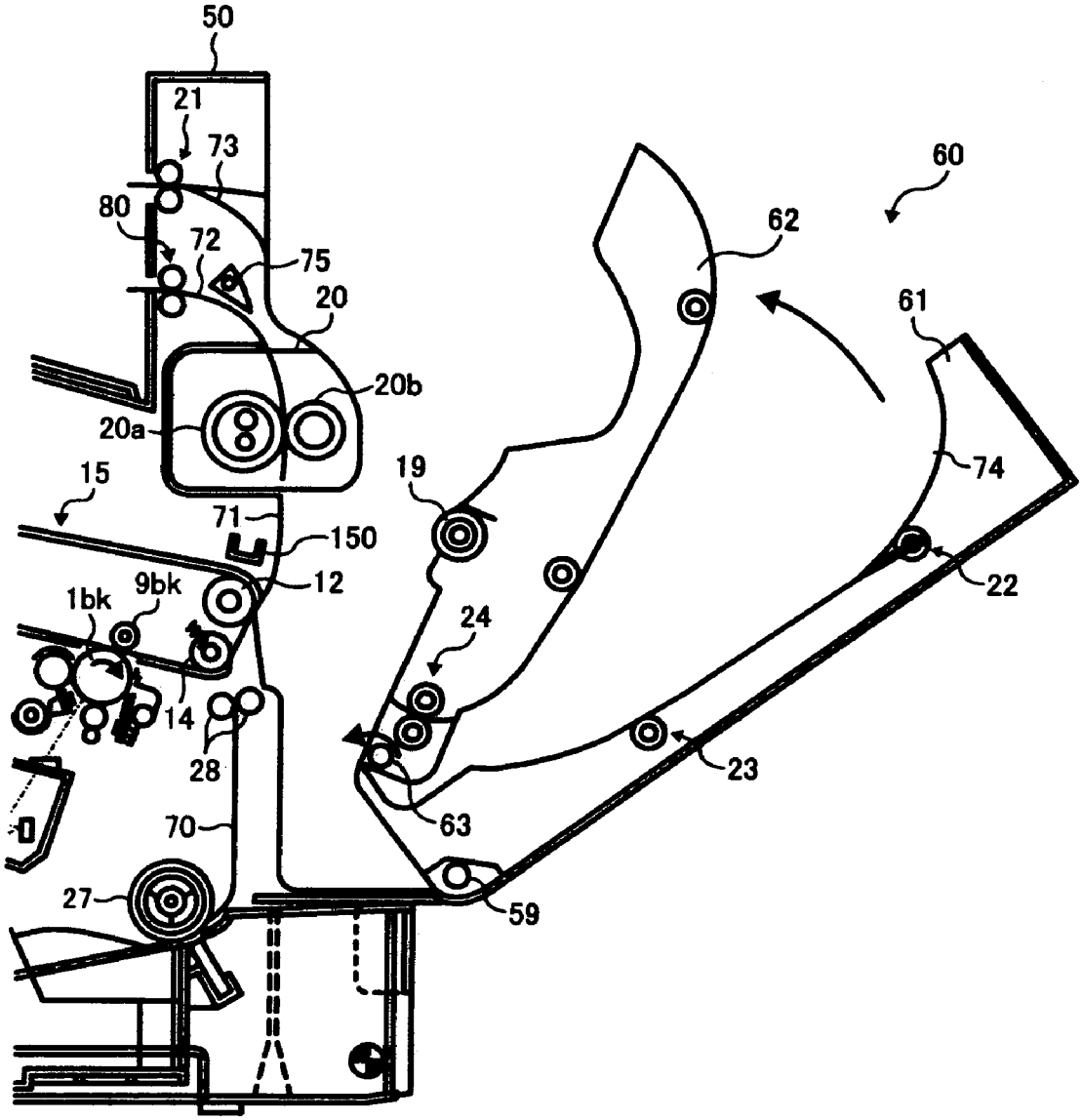
FIG. 4 is a cross sectional view of the image forming apparatus according to the exemplary embodiment of the present invention, when an external cover plate and a pivotably supporting member of the cover are separated from each other.
Figure 5:
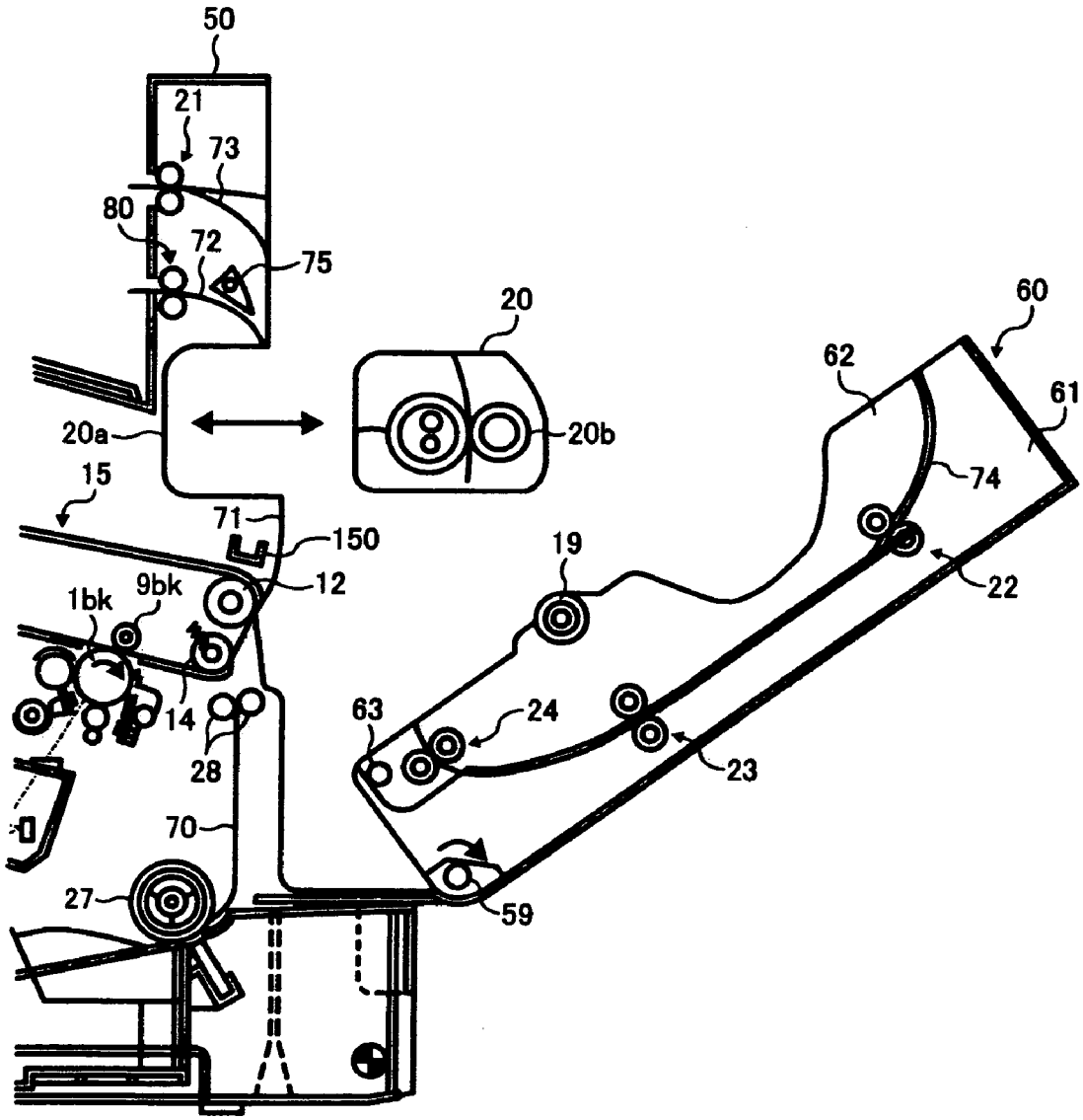
FIG. 5 is a cross sectional view of the image forming apparatus according to the exemplary embodiment of the present invention, when a fixing unit is detached from the image forming apparatus.

When the external cover plate 61 is moved, the pivotable supporting member 62 is exposed as shown in FIG. 3. The pivotable supporting member 62 pivotably moves about a second rotating shaft 63 provided in the housing 50 of the printer 100. The pivotable supporting member 62 can be opened to be separated from the external cover plate 61 as shown in FIG. 4.

The printer 100 of FIG. 1 shows a first position of the cover 60. More specifically, in FIG. 1, the cover 60 of the printer 100 is closed and the pivotable supporting member 62 is held in contact with the external cover plate 61.

When the cover 60 is closed or in the first position as described above, the sheet conveying paths including the post-transfer sheet conveying path 71 and the sheet discharging path 72 are formed between the pivotable supporting member 62 and the housing 50. That is, the transfer sheet S passes through the secondary transfer nip portion formed between the intermediate transfer belt 8 and the secondary transfer bias roller 19 so that the full color toner image can be transferred from the intermediate transfer belt 8 onto the transfer sheet S.

When the cover 60 is moved about the first rotating shaft 59 to open as shown in FIG. 3, the housing 50 and the pivotable supporting member 62 are separated to a position, which is hereinafter referred to as a second position. With the second position of the cover 60, the post-transfer sheet conveying path 71 and the sheet discharging path 72 are exposed, and thereby operations such as the removal of a jammed paper can easily be performed.

When the cover 60 is opened as shown in FIG. 3, a portion of the fixing unit 20 mounted on the housing 50 may be exposed. As previously described, the fixing unit 20 is detachable with respect to the housing 50. Whenever the cover 60 is opened, the fixing unit 20 can be detached from and attached to the housing 50 of the printer 100.

With the cover 60 remaining in the second position, the pivotable supporting member 62 can be separated from the external cover plate 61. The above-described position of the cover 60 as shown in FIG. 4 is hereinafter referred to as a third position.

In a predetermined distance between the external cover plate 61 and the pivotable supporting member 62 of the cover 60, the reverse sheet conveying path 74 is formed. When the cover 60 is angularly moved about the first rotating shaft 59 to the third position so that the housing 50 and the pivotable supporting member 62 can be separated as shown in FIG. 4, the reverse sheet conveying path 74 are exposed. By moving the cover 60 to the second position to expose the reverse sheet conveying path 74, operations such as the removal of a jammed paper remaining in the reverse sheet conveying path 74 can easily be performed.

While the components of the transfer unit 15 generally remain in the housing 50, the secondary transfer bias roller 19 that is fixedly mounted to the cover 60 and supported by the pivotable supporting member 62 is moved in synchronization with the movement of the cover 60.

Figure 6:
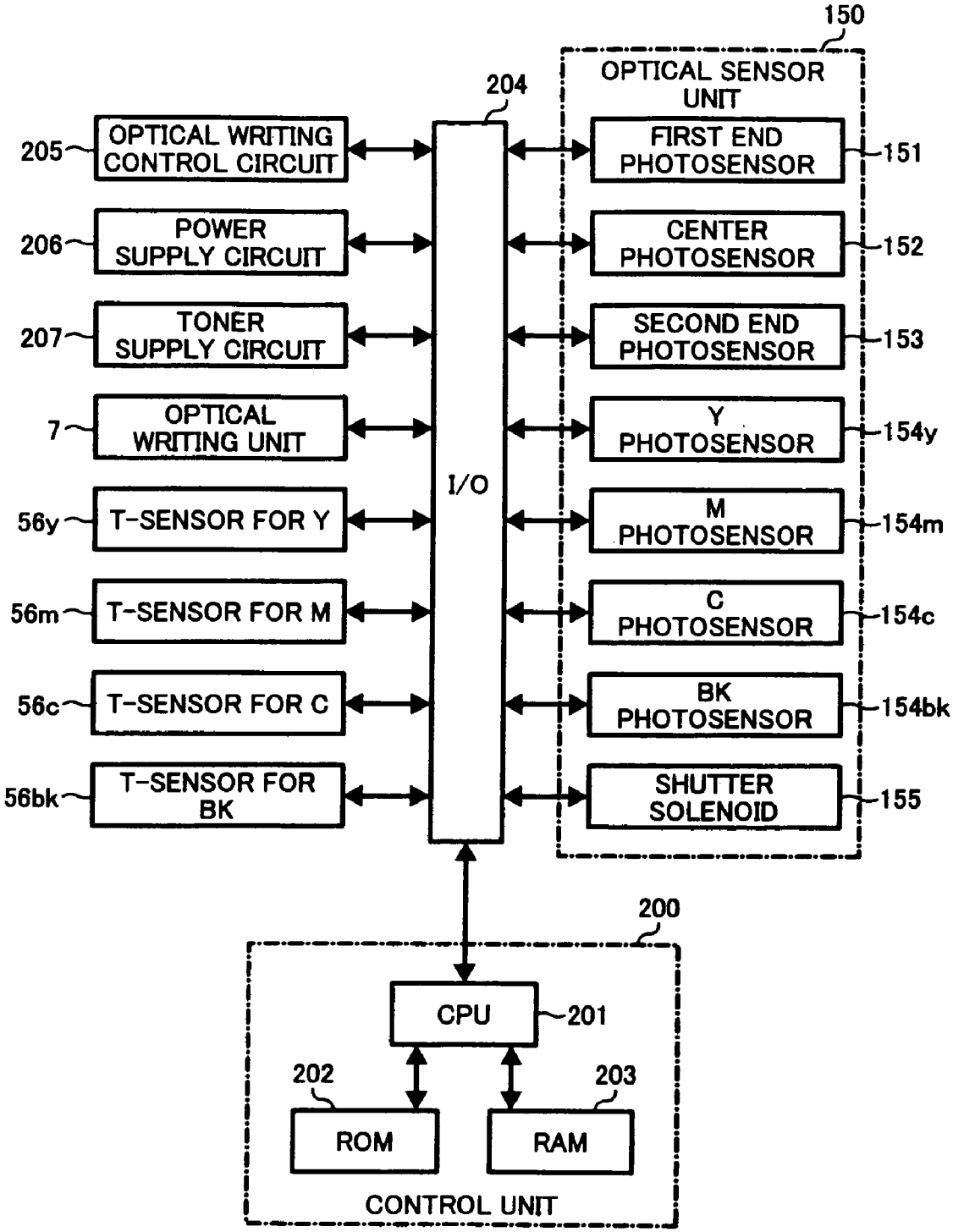
FIG. 6 is a block diagram showing a portion of electric circuits of the image forming apparatus according to the exemplary embodiment of the present invention.

Referring to FIG. 6, a block diagram showing a portion of electric circuits of one exemplary embodiment of the printer 100 is described.

In FIG. 6, the printer 100 includes the optical sensor unit 150, the control unit 200, and an input and output (I/O) interface 204.

The control unit 200 serving as a calculating unit for the operations of the printer 100 includes a central processing unit (CPU) 201, a read only memory (ROM) 202 storing various control programs and data, and a random access memory (RAM) 203 temporarily storing the various data.

The I/O interface 204 receives and sends various signals with respect to the peripheral control units.

The control unit 200 is connected via the I/O interface 204 to the optical writing unit 7, T-sensors 56*y*, 56*m*, 56*c*, and 56*bk*, an optical writing operation control circuit 205 that is dedicated to the controls of the optical writing unit 7, a power supply circuit 206, and a toner supply circuit 207.

The control unit 200 is also connected to the optical sensor unit 150. The optical sensor unit 150 includes a first end photosensor 151, a central photosensor 152, a second end photosensor 153, a photosensor for yellow toner or a yellow toner photosensor 154*y*, a photosensor for magenta toner or a magenta toner photosensor 154*m*, a photosensor for cyan toner or a cyan toner photosensor 154*c*, a photosensor for black toner or a black toner photosensor 154*bk*, and a shutter solenoid 155. The photosensors 154*y*, 154*m*, 154*c*, and 154*bk* are reflective type photosensors that reflect light emitted from respective light emitting units (not shown) and detect the reflected light with respective light emitting units (not shown).

The optical writing operation control circuit 205 controls the optical writing unit 7 based on instructions issued by the control unit 200 via the I/O interface 204.

The power supply circuit 206 applies a high voltage to the charging unit 4 of the process cartridge 6 based on instructions issued by the control unit 200 via the I/O interface 204, and applies a development bias to the developing roller 51 of the developing unit 5.

The toner supply circuit 207 controls the toner bottles 32*y*, 32*m*, 32*c*, and 32*bk* serving as the toner feeding mechanism, based on instructions issued by the control unit 200 via the I/O interface 204, so as to control the amounts of toner replenished from the toner bottles 32*y*, 32*m*, 32*c*, and 32*bk* to the corresponding developing units including the developing unit 5.

The control unit 200 sends instructions based on the output values output from the T-sensors 56*y*, 56*m*, 56*c*, and 56*bk* via the I/O interface 204 to the toner supply circuit 207. According to the instructions, the toner densities of the two-component developer accommodated in the respective developing units 5 may be kept in a reference toner density level.

Figure 7:
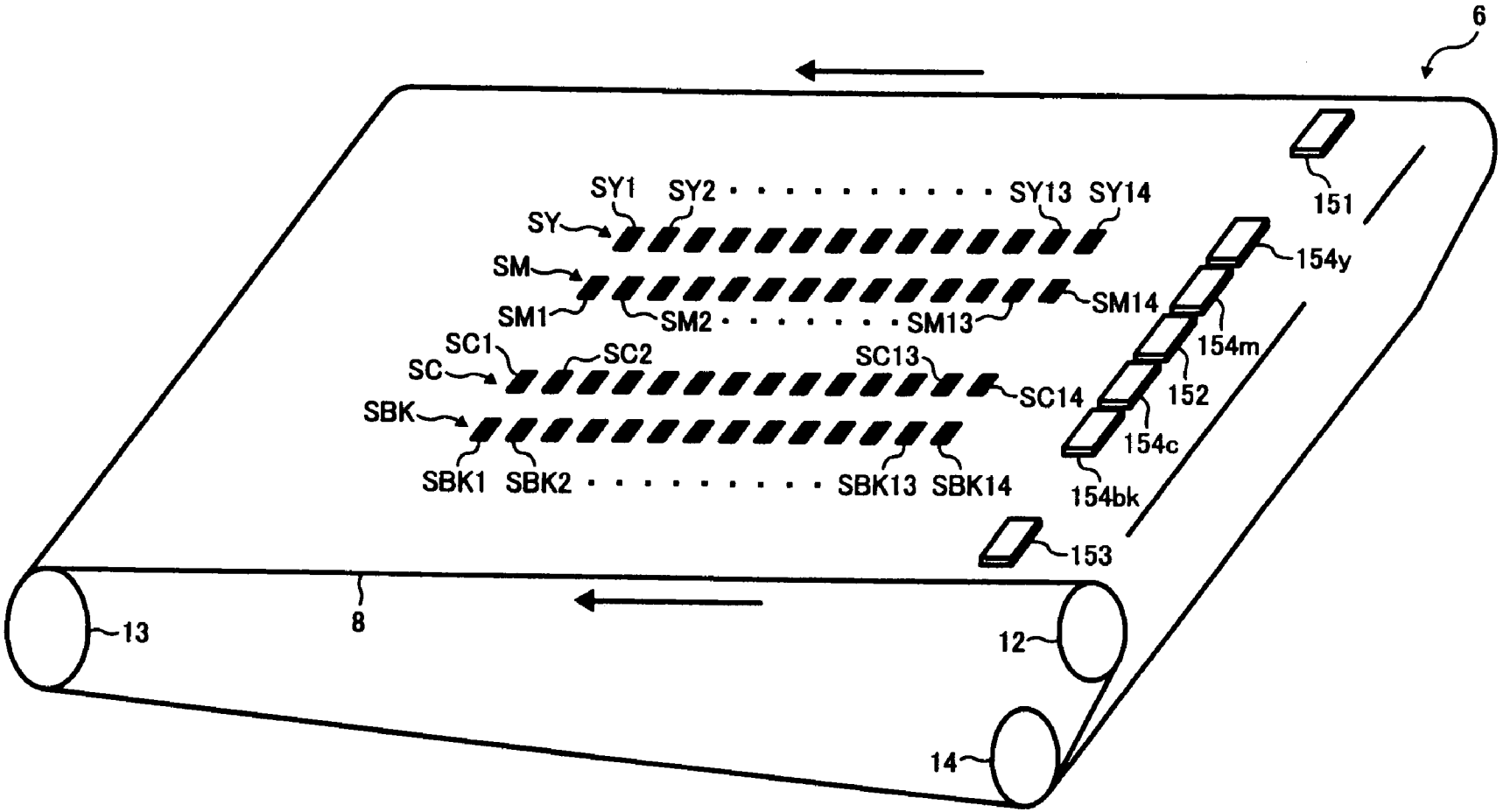
FIG. 7 is a perspective view of reference toner images formed on a transfer member of the image forming apparatus, according to the exemplary embodiment of the present invention.

Referring to FIG. 7, a schematic structure of the intermediate transfer belt 8 with reference toner images formed thereon is described.

The printer 100 is controlled to perform the following image forming operations at respective predetermined timings. More specifically, the printer 100 can cause the optical writing operation control circuit 205 to control the optical writing unit 7 based on instructions issued by the control unit 200 via the I/O interface 204.

The printer 100 can also cause the control unit 200 to control the process cartridges 6*y*, 6*m*, 6*c*, and 6*bk* and the transfer unit 15. With the above-described controls, a group of reference toner images or a reference toner image group can be formed on the intermediate transfer belt 8 to detect image forming ability of the printer 100. More specifically, the reference toner image group includes four reference toner image sets, which are a reference yellow toner image set SY, a reference magenta toner image set SM, a reference cyan toner image set SC, and a reference black toner image set SBK. Each of the four reference toner image sets SY, SM, SC, and SBK includes 14 reference toner images. The respective 14 reference toner images are formed by predetermined different pixel patterns having respective amounts of attached toner different from each other. As shown in FIG. 7, the reference yellow toner image sets SY includes reference toner images SY1, SY2, . . . SY13, and SY14, the reference magenta toner image sets SM includes reference toner images SM1, SM2 . . . SM13, and SM14, the reference cyan toner image sets SC includes reference toner images SC1, SC2 . . . SC13, and SC14, and the reference black toner image sets SBK includes reference toner images SBK1, SBK2, . . . SBK13, and SBK14.

For example, the reference toner images SBK1, SBK2, . . . SBK13, and SBK14 of the reference black toner image set SBK have respective amounts of attached toner that are gradually increased. The respective amounts of attached toner per unit area with respect to the reference toner images SBK1, SBK2, . . . SBK13, and SBK14 of the reference black toner image set SBK are detected by the black toner photosensor 154*bk* of the optical sensor unit 150. The detection results are sent as an output value Vpi ("i" can be any of 1 to 14 corresponding to the reference toner images SBK1, SBK2, . . . SBK13, and SBK14) via the I/O interface 204 to the RAM 203 in which the detection results are stored.

The identical operation performed for the reference black toner image sets SBK can be applied to the reference yellow, magenta and cyan toner image sets SY, SM, and SC. The detection results that are the output values Vp1 through Vp14 are also sent via the I/O interface 204 to the RAM 203.

Based on the output values stored in the RAM 203 and a data table stored in the ROM 202, the control unit 200 calculates the output values to the corresponding amount of attached toner per unit area and stores the calculation results as data of the amounts of attached toner to the RAM 203.

Figure 8:
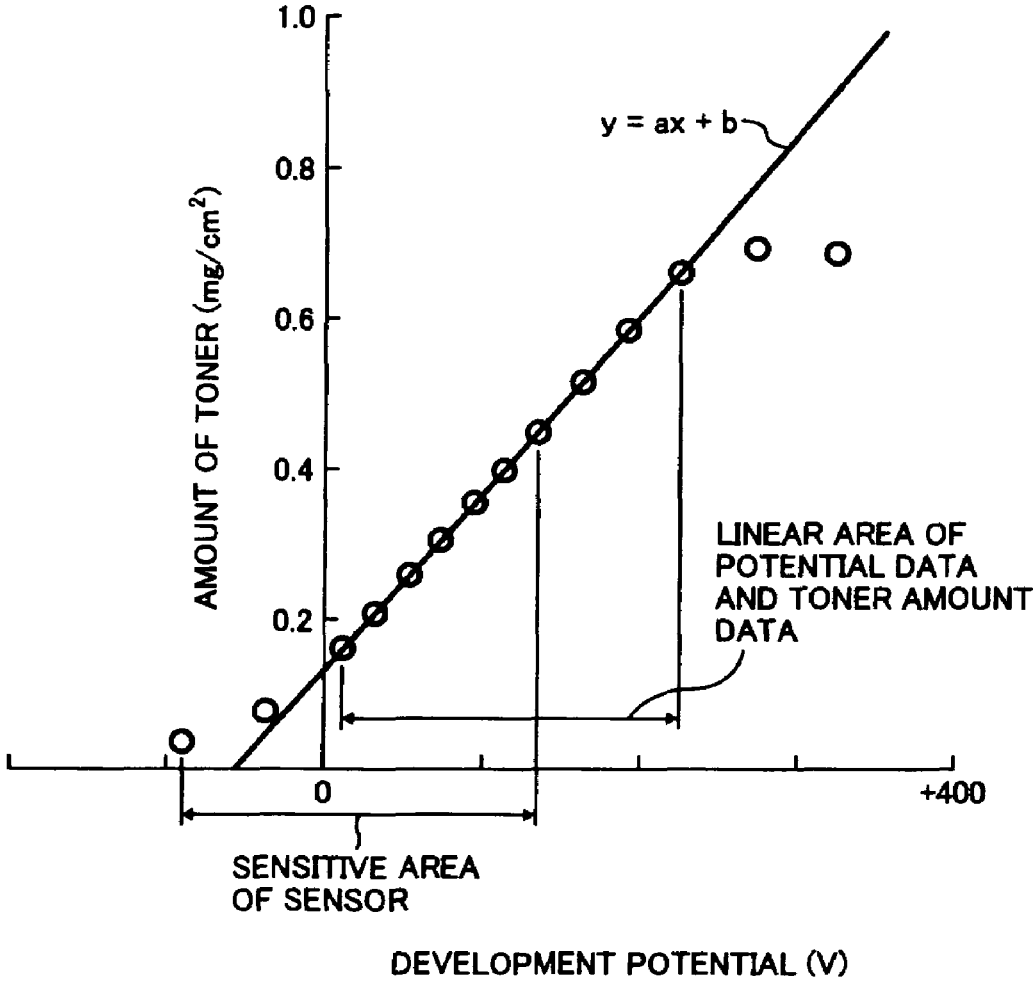
FIG. 8 is a graph showing a relationship of potentials of photoconductive elements of the image forming apparatus according to the exemplary embodiment of the present invention and corresponding amounts of toner adhered on the transfer member.

Referring to FIG. 8, a graph showing a relationship of potentials of the photoconductive drums 1*y*, 1*m*, 1*c*, and 1*bk* of the printer 100 and the corresponding amounts of toner adhered on the intermediate transfer belt 8 is described.

The graph of FIG. 8 has plotted the relationship in an x-coordinate and a y-coordinate. The x-coordinate represents a development potential (Unit: "V"), which is a difference between a developing bias voltage applied when the reference toner images on the intermediate transfer belt 8 are formed and a surface potential of each of the photoconductive drums 1*y*, 1*m*, 1*c*, and 1*bk*. The y-coordinate represents an amount of attached toner upper unit area (Unit: "mg/cm$^2$").

The control unit 200 refers to the development potential data and the toner amount data stored in the RAM 203, then selects, by each color of toner, an area in which the development characteristic or the relationship of the development potential data and the toner amount data forms a linear line, and performs a smoothing operation of the above-described data. After the smoothing operation has been performed, the control unit 200 applies a least squares method with respect to the smoothed data to perform a collinear approximation of the development characteristic of each developing unit 5. Further, the control unit 200 obtains, for each color of toner, an equation of a straight line of the development characteristic of the developing unit 5. The equation is y=ax+b. The control unit 200 then adjusts the image forming ability of each of the process cartridges 6*y*, 6*m*, 6*c*, and 6*bk* based on an inclination "a" in the equation.

The image forming ability can be adjusted using a method adjusting the uniform charge potential of a photoconductive drum and a developing bias or another method adjusting the toner density of a two-component developer.

As shown in FIG. 7, in the adjustment of the image forming ability, the reference yellow toner image set SY including the reference toner images SY1, SY2, . . . SY13, and SY14 is formed in predetermined pitches in a moving direction or in a sub-scanning direction of the intermediate transfer belt 8. The reference magenta toner image set SM including the reference toner images SM1, SM2, . . . SM13, and SM14 is formed in predetermined pitches in the sub-scanning direction of the intermediate transfer belt 8 and in a main scanning direction of or in parallel with the reference yellow toner image set SY. The reference cyan toner image set SC including the reference toner images SC1, SC2, . . . SC13, and SC14 is formed in predetermined pitches in the sub-scanning direction of the intermediate transfer belt 8 and in a main scanning direction of or in parallel with the reference magenta toner image set SM. The reference black toner image set SBK including the reference toner images SBK1, SBK2, . . . SBK13, and SBK14 is formed in predetermined pitches in the sub-scanning direction of the intermediate transfer belt 8 and in a main scanning direction of or in parallel with the reference cyan toner image set SC.

Figure 9:
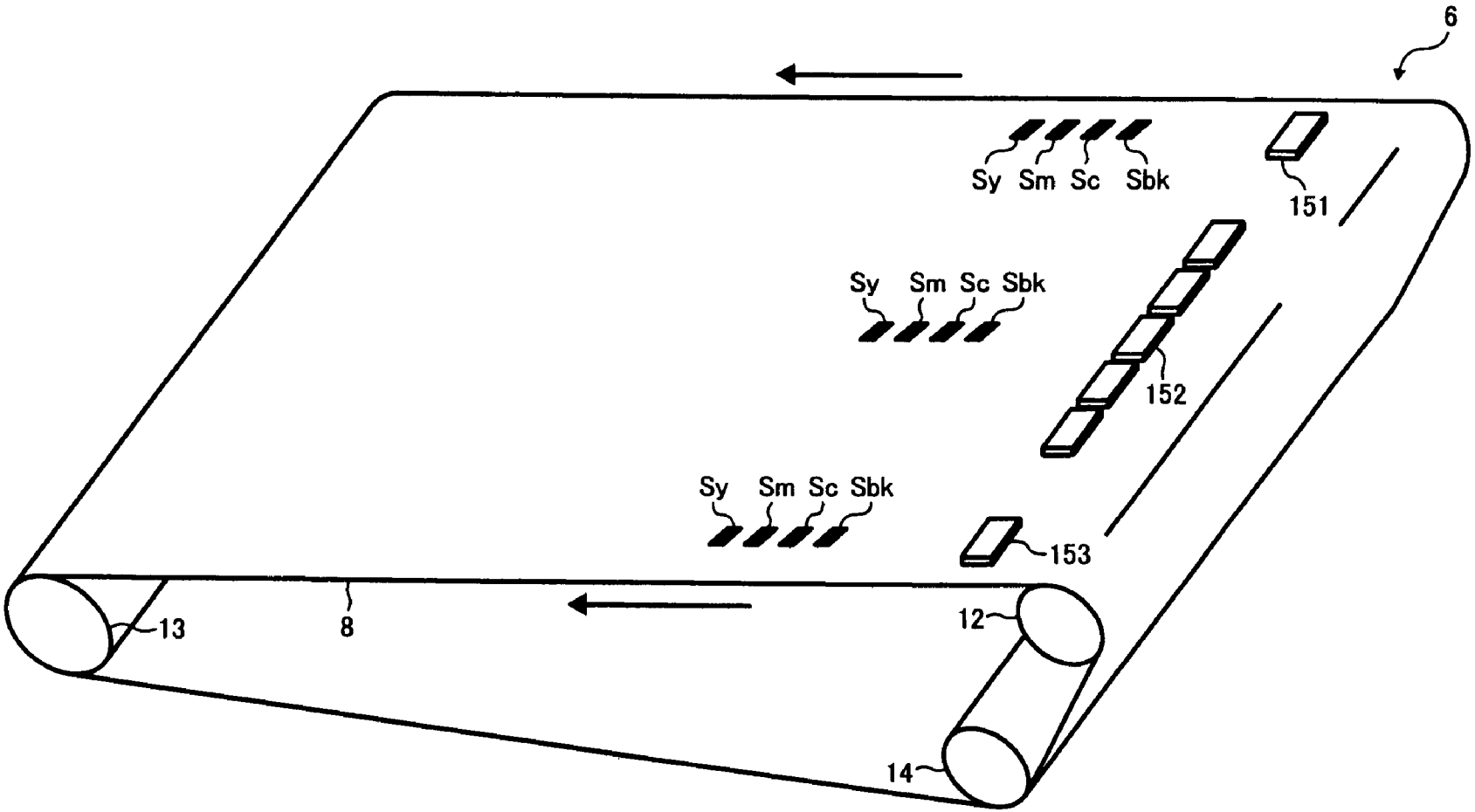
FIG. 9 is a perspective view of patch patterns formed on the transfer member of the image forming apparatus according to the exemplary embodiment of the present invention.

Referring to FIG. 9, a schematic structure of the intermediate transfer belt 8 with patch patterns formed thereon is described.

The printer 100 also has a function to perform a registration skew adjustment at a predetermined timing. More specifically, three sets of patch patterns for detecting registration skew are formed at both ends and at the center of the intermediate transfer belt 8 along a widthwise direction of the intermediate transfer belt 8, as shown in FIG. 9. Each of the respective sets of patch patterns includes four reference toner images Sy, Sm, Sc, and Sbk disposed in predetermined pitches in the sub-scanning direction of the intermediate transfer belt 8. The reference toner images Sy, Sm, Sc, and Sbk are arranged to locate the respective reference toner images of the same color in a linear line in the main scanning direction.

The first end photosensor 151 detects the reference toner images Sy, Sm, Sc, and Sbk of the patch pattern that is formed in the vicinity of the far side in the widthwise direction of the intermediate transfer belt 8. The central photosensor 152 detects the reference toner images Sy, Sm, Sc, and Sbk of the patch pattern that is formed in the vicinity of the center portion in the widthwise direction of the intermediate transfer belt 8. The second end photosensor 153 detects the reference toner images Sy, Sm, Sc, and Sbk of the patch pattern that is formed in the vicinity of the near side in the widthwise direction of the intermediate transfer belt 8.

When the image forming timings of each of the respective reference toner images Sy, Sm, Sc, and Sbk are appropriate to each other, the intervals of forming and detecting the respective reference toner images Sy, Sm, Sc, and Sbk may be equal. On the contrary, when the image forming timings of each of the respective reference toner images Sy, Sm, Sc, and Sbk are not appropriate, the intervals of forming and detecting the respective reference toner images Sy, Sm, Sc, and Sbk cannot be equal.

Further, when the respective reference toner images are optically written in an accurate manner, the reference toner images of the same color in the three sets of patch patterns should be detected simultaneously. However, when image skew occurs, the detection timings may be different from each other.

Thus, the control unit 200 detects skew in image based on the intervals and timings of the respective toner images in the main scanning and sub-scanning directions and adjusts the optical image components so that image shifts and skews on the toner images of each color can be prevented.

More specifically, the control unit 200 calculates the amount of image skew as a predetermined variable based on the detection result of the above-described plurality of photosensors 151, 152, 153, 154*y*, 154*m*, 154*c*, and 154*bk*. The image skew is formed in a direction perpendicular to the moving direction of the intermediate transfer belt 8 with respect to the respective toner images transferred on the intermediate transfer belt 8. With the calculation result, the image skew of each of the respective toner images can be corrected.

The control unit 200 also calculates the amount of image shift as a predetermined variable based on the detection result of the above-described plurality of photosensors 151, 152, 153, 154*y*, 154*m*, 154*c*, and 154*bk*. The image shift is formed in the moving direction of the intermediate transfer belt 8 with respect to the respective toner images formed on the intermediate transfer belt 8. With the calculation result, the image shift of each of the respective toner images in the sub-scanning direction can be corrected.

The control unit 200 further calculates the amount of attached toner per unit area as a predetermined variable based on the detection result of the above-described plurality of photosensors 151, 152, 153, 154*y*, 154*m*, 154*c*, and 154*bk*. With the calculation result, the image forming ability of each of the process units and/or the volume of toner that should be added to the developing unit 5 can be arranged.

When the reference toner image sets SY, SM, SC, and SBK or the patch patterns Sy, Sm, Sc, and Sbk are formed, the secondary transfer bias roller 19 shown in FIG. 1 is separated from the intermediate transfer belt 8 so that the reference toner image sets SY, SM, SC, and SBK or the patch patterns Sy, Sm, Sc, and Sbk may not be transferred onto the secondary transfer bias roller 19.

Figure 10:
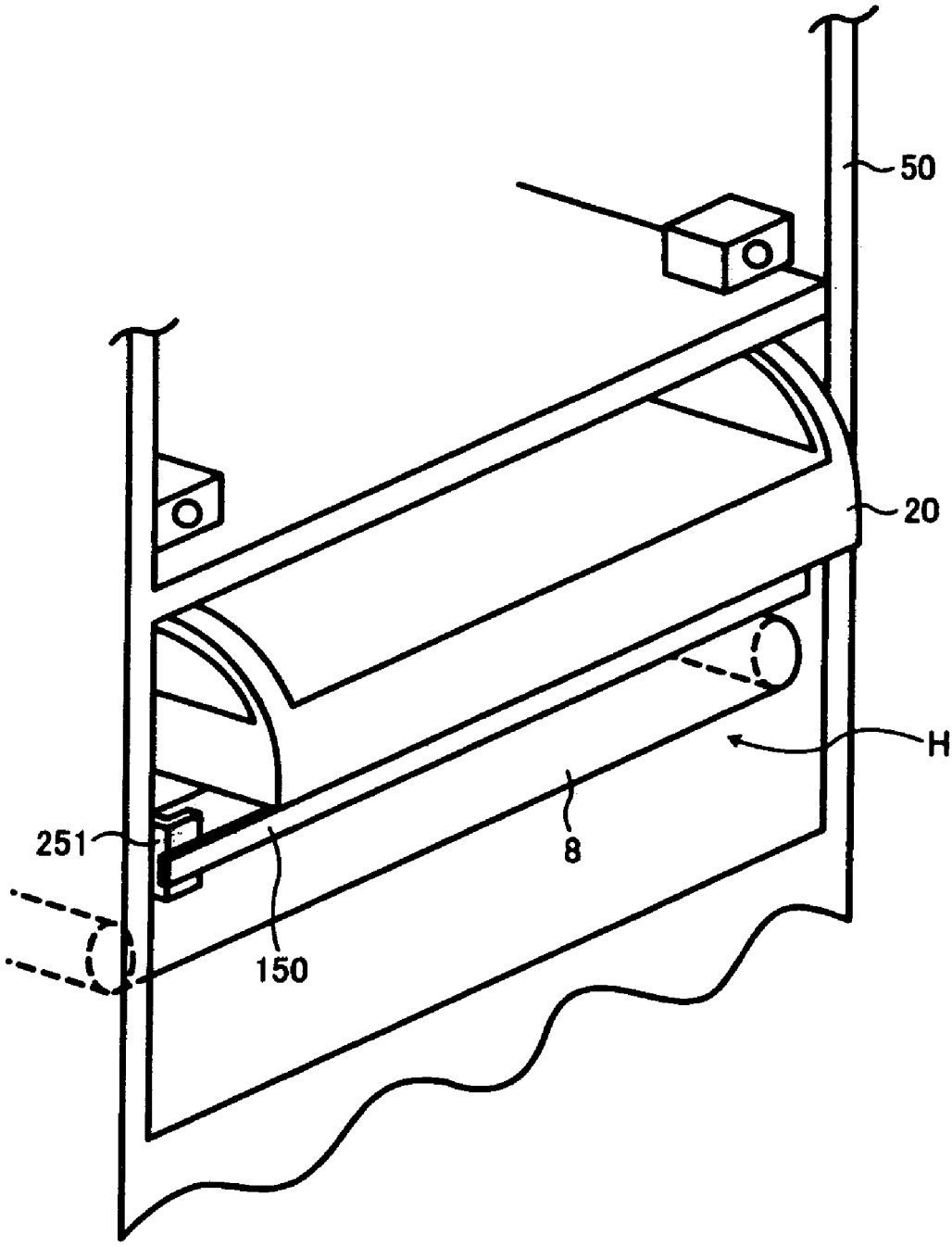
FIG. 10 is perspective view of a portion of a housing of the image forming apparatus according to the exemplary embodiment of the present invention.

Referring to FIG. 10, a schematic structure of the housing 50 when the cover 60 is opened is described.

When the cover 60 is opened, an opening H provided in the housing 50 of the printer 100 may be exposed. The opening H is formed to expose therethrough, a portion of the intermediate transfer belt 8 including an entire range or width from one end to the other end in a direction perpendicular to the moving direction of the surface of the intermediate transfer belt 8.

As previously described, the optical sensor unit 150 is disposed between the fixing unit 20 and the thus exposed intermediate transfer belt 8. The optical sensor unit 15 is fixedly mounted facing the exposed surface of the intermediate transfer belt 8. The photosensors including the first end, second end, and central photosensors 151, 152, and 153 are arranged in the main scanning direction, which is the longitudinal direction of the optical sensor unit 150.

Figure 11:
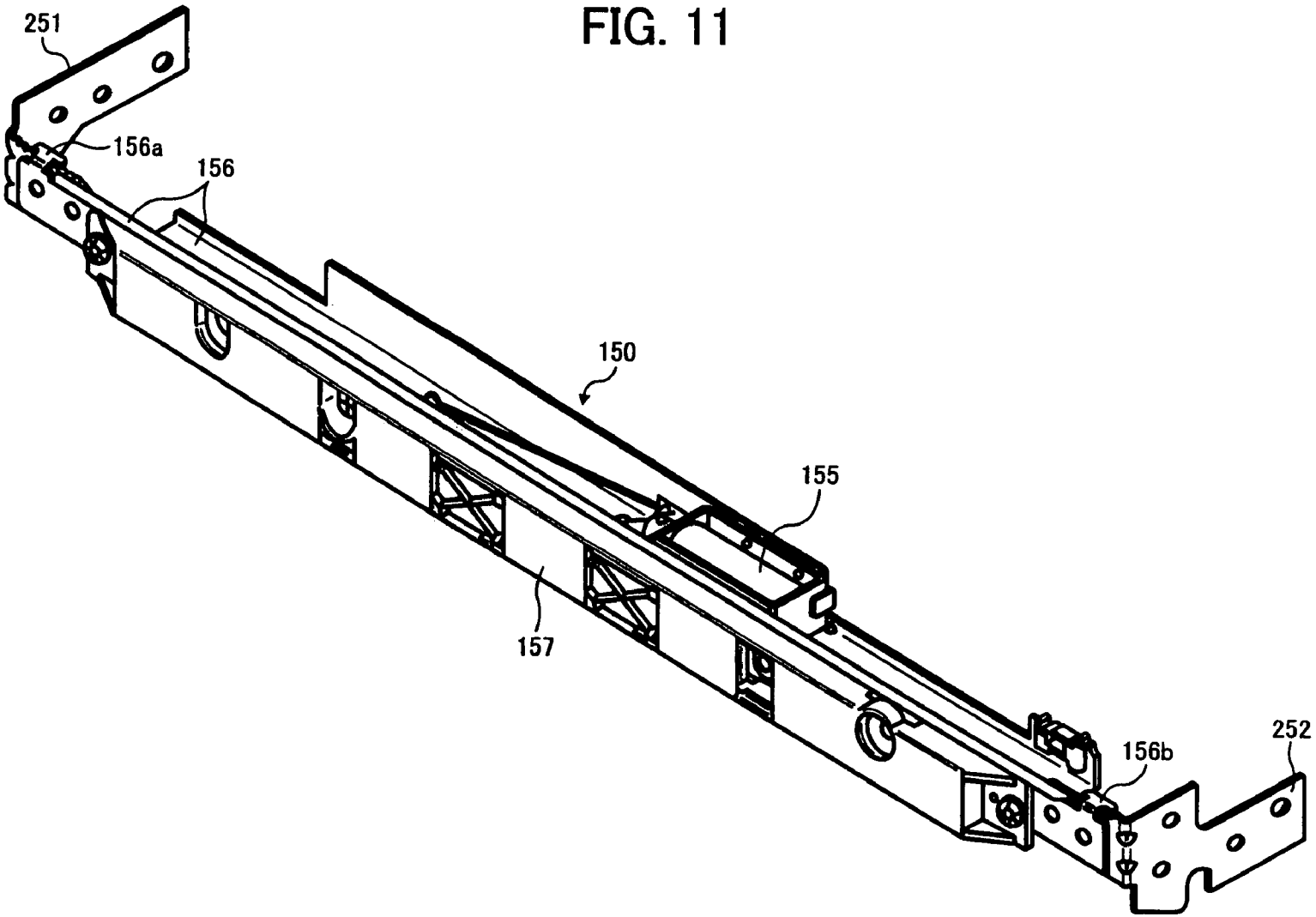
FIG. 11 is a perspective view of an optical sensor unit and fixing members of the image forming apparatus according to the exemplary embodiment of the present invention.

The housing 50 of the printer 100 includes first and second housing plates (not shown) with first and second fixing members 251 and 252 (the second fixing member 252 is shown in FIG. 11).

The first fixing member 251 is a steel L-frame member. One surface of the first fixing member 251 has an L-shape and is fixedly mounted on the inner surface of the first housing plate, and another surface thereof, which extends in a direction perpendicular to the one surface thereof, faces the opening H. That is, the above-described portion of the first fixing member 251 facing the opening H and ranging in a direction perpendicular to the moving direction of the surface of the intermediate transfer belt 8 can be seen through the opening H.

The second fixing member 252 (see FIG. 11) is also a steel L-frame member. One surface of the second fixing member 252 is fixedly mounted on the inner surface of the second housing plate, and another surface thereof faces the opening H. The above-described portion of the second fixing member 252 facing the opening H and ranging in a direction perpendicular to the moving direction of the surface of the intermediate transfer belt 8 can also be seen through the opening H. The exposed portion of the second fixing member 252 is fixedly mounted on the other end of the optical sensor unit 150.

With the above-described structure of the housing 50 of the printer 100, both ends in the longitudinal direction of the optical sensor unit 150 can easily be seen from the outside of the housing 50 of the printer 100. Therefore, when a technical representative or a user detaches and then reattaches the optical sensor unit 150 to the printer 100, the mounting locations for the optical sensor unit 150 provided at the above-described exposed portions of the first and second fixing member 251 and 252 can easily be confirmed, thereby the optical sensor unit 150 can be mounted without causing any positioning error.

Referring to FIG. 11, a schematic structure of one non-limiting embodiment of the optical sensor unit 150 and the first and second fixing members 251 and 252 mounted on the optical sensor unit 150 is described.

As previously described with reference to the exposed portion of the housing 50 of the printer 100 in FIG. 10, the steel L-frame first fixing member 251 is mounted on the first housing plate (not shown), and the second housing plate (not shown) has the steel L-frame second fixing member 252 mounted thereon. The first and second fixing members 251 and 252 are attached such that the respective surfaces thereof, which are different from the surfaces attached to the first and second housing plates, face the opening H.

The optical sensor unit 150 includes a holding member 156 having a steel C-frame and a sensor cover 157.

The holding member 156 includes first and second engaging members 156*a* and 156*b*, which will be described later.

The holding member 156 holds the above-described seven photosensors 151, 152, 153, 154*y*, 154*m*, 154*c*, and 154*bk* on one surface thereof. The sensor cover 157, which is typically made of resin, covers the above-described seven photosensors except the respective detecting portions of the photosensors.

The holding member 156 is fixedly mounted on the first and second fixing members 251 and 252 such that the opened side of the C-frame holding member 156 faces in an upward direction. More specifically, with the opened side of the holding member 156 facing up, one end portion in the longitudinal direction of the holding member 156 is attached, preferably by screw, to the exposed surface of the first fixing member 251. The other end portion in the longitudinal direction of the holding member 156 is attached, preferably by screw, to the exposed surface of the second fixing member 252. Thus, both of the end portions in the longitudinal direction of the holding member 156, or in the direction along which the photosensors are arranged, are fixed to the respective exposed surfaces of the first and second fixing members 251 and 252.

With the above-described structure, the optical sensor unit 150 may be fixed to the first and second fixing members 251 and 252 mounted straight in front of the opening H, which can avoid a time consuming procedure such as a visual check with a sidelong look at the positions of the plurality of photosensors through the opening H. Thereby, operability in mounting and demounting the optical sensor unit 150 can be increased.

As shown in FIG. 10, the opening H of the housing 50 of the printer 100 is formed in a shape extending in a direction of gravitational force or in a vertical direction. Further, as shown in FIG. 11, both of the exposed surfaces of the first and second fixing members 251 and 252 are also formed in a shape extending in the direction of gravitational force or in the vertical direction. As previously described, the holding member 156 of the optical sensor unit 150 includes the first and second engaging members 156*a* and 156*b*. Each of the first and second engaging members 156*a* and 156*b* has an upper end portion that is bent toward the backside thereof.

The upper end portion of the first engaging member 156*a* may be engaged with the upper portion of the first fixing member 251 in the vertical direction of the first fixing member 251 so that one end portion of the holding member 156 can temporarily be engaged between the opening H of the housing 50 and the exposed surface of the first fixing member 251, which is the surface facing the opening H.

The upper end portion of the second engaging member 156*b* may be engaged with the upper portion of the second fixing member 252 in the vertical direction of the second fixing member 252 so that the other end portion of the holding member 156 can temporarily be engaged between the opening H of the housing 50 and the exposed surface of the second fixing member 252, which is the surface facing the opening H.

In other words, tabs or hook-like projections on each end of the holding member 156 may be used to temporarily attach the holding member 156 to the fixing members 251 and 252.

Accordingly, while the first and second engaging members 156*a* and 156*b* are being engaged with the first and second fixing members 251 and 252, respectively, the holding member 156 can temporarily be engaged with the first and second fixing members 251 and 252. Thereby, both of the end portions of the holding member 156 can be moved to the respective proper positioning locations. The above-described operations for positioning the holding member 156 can increase operability of positioning the optical sensor unit 150.

As shown in FIG. 10, the optical sensor unit 150 is arranged in the vertical direction at a position above the intermediate transfer belt 8 of the printer 100. As previously described, when the optical sensor unit 150 is mounted to the printer 100, the first and second engaging members 156*a* and 156*b* are engaged with the first and second fixing members 251 and 252, respectively, so that the holding member 156 can temporarily be engaged with the first and second fixing members 251 and 252. With the above-described structure, the optical sensor unit 150 can be prevented from falling in the vertical direction onto the intermediate transfer belt 8. It should be noted that the optical sensor unit can be mounted in other orientations such as beside or below the intermediate transfer belt, as long as the sensors can view the surface of the intermediate transfer belt.

As previously described, the sensor cover 157 covers the photosensors mounted on one side of the holding member 156 of the optical sensor unit 150, as shown in FIG. 11. More specifically, the holding member 156 has a C-shaped cross section in a direction perpendicular to the longitudinal direction thereof, that is, the holding member 156 has three planar surfaces. The photosensors are mounted on the near side plane surface.

The near side planar surface has two sides, which are the first and second sides thereof. The first and second fixing members 251 and 252 are mounted and fixed in close contact with the first side of the near side plane surface of the holding member 156, and the photosensors are mounted on the second side thereof.

In this non-limiting embodiment, the optical sensor unit 150 has no bend on the near side plane surface of the holding member 156 and the respective mounting sides of the photosensors to be held in contact on the near surface of the holding member 156. Thereby, the optical sensor unit 150 of the printer 100 can prevent misregistration of the respective photosensors due to any error in accuracy of the bending process of the holding member 156.

As previously described, the seven photosensors typically include the first end photosensor 151, the central photosensor 152, the second end photosensor 153, the yellow toner photosensor 154*y*, the magenta toner photosensor 154*m*, the cyan toner photosensor 154*c*, and the black toner photosensor 154*bk*. The photosensors 151, 152, 153, 154*y*, 154*m*, 154*c*, and 154*bk* are the reflective type photosensors that reflect light emitted from the respective light emitting units, and receive the light reflected from the surface of the intermediate transfer belt 8 so as to detect the amount of reflected light. Each of the photosensors 151, 152, 153, 154*y*, 154*m*, 154*c*, and 154*bk* includes a light emitting window that passes the light emitted from the light emitting units to the outside and a light receiving window that receives the light reflected from the outside. When being contaminated with toner adhesion, the light emitting and receiving windows cannot detect accurate optical reflectance. To avoid the contamination due to toner adhesion, the printer 100 is provided with a shutter 160, as shown in FIG. 12, for the photosensors for opening and closing the light emitting and receiving windows as necessary.

Figure 12:
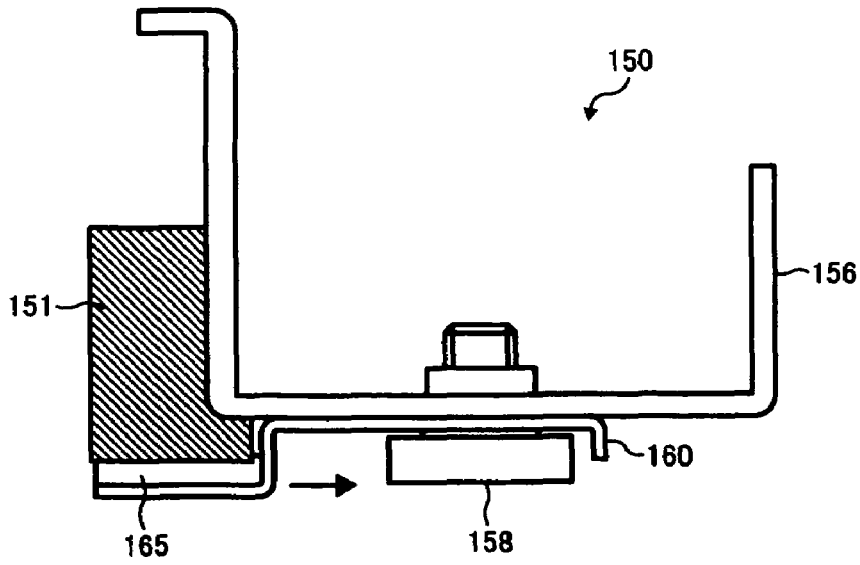
FIG. 12 is a cross sectional view of the optical sensor unit when a shutter of the optical sensor unit is closed.

Still referring to FIG. 12, a schematic structure of the optical sensor unit 150 viewed from one side thereof is described.

FIG. 12 shows a cross sectional view of the optical sensor unit 150 in the vicinity of the first end photosensor 151 mounted thereon when the shutter 160 of the optical sensor unit 150 is closed. The first end photosensor 151 is mounted on the second side of the near side plane surface of the holding member 156 with the light emitting and receiving windows facing down. The shutter 160 is mounted on the second side of the near side plane surface of the holding member 156. The shutter 160 is slidable in the horizontal direction in FIG. 12. The left end portion of the shutter 160 in FIG. 12 is located immediately below the first end photosensor 151, which shuts the light emitting and receiving windows of the first end photosensor 151 to block the light traffic. The photosensors other than the first end photosensor 151 cannot be seen in FIG. 12 because the photosensors are arranged behind the first end photosensor 151 in the direction perpendicular to the page in FIG. 12.

The shutter 160 is formed in a long plate extending in the direction perpendicular to the face of the drawing. The shutter 160 shown in FIG. 12 blocks each of the respective light emitting and receiving windows of the photosensors.

The shutter 160 includes a seal 165. The seal 165 is formed by an elastic material such as a sponge, and is mounted on the shutter 160 so as to face, for example, the first end photosensor 151 to infill a gap between the first end photosensor 151 and the shutter 160.

The seal 165 can be formed in one long plate to cover the entire range of the photosensors. However, as an alternative, the seal 165 can be formed in individual plates corresponding to the number of the photosensors.

Figure 13:
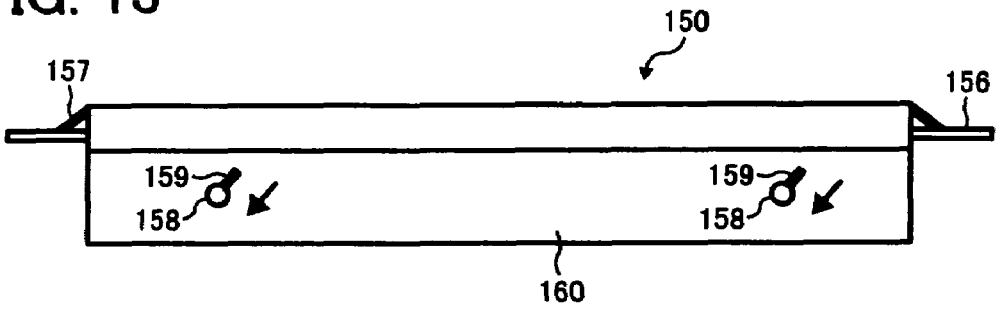
FIG. 13 is a plan view of the optical sensor unit viewed from the bottom thereof, when the shutter of the optical sensor unit is closed.
Figure 14:
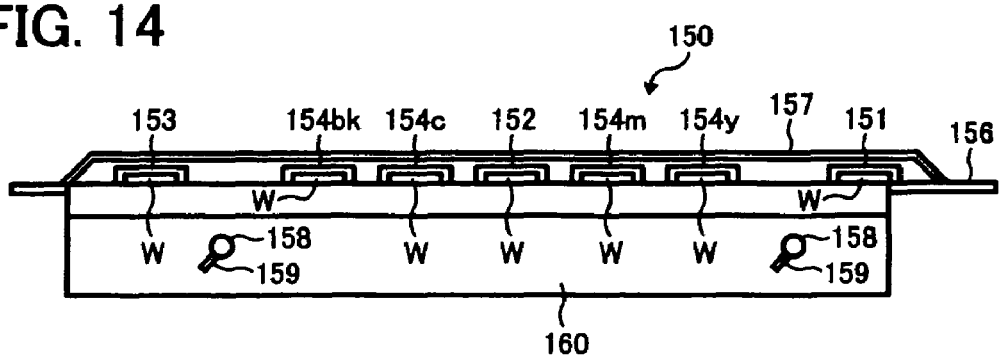
FIG. 14 is another plan view of the optical sensor unit viewed from the bottom thereof, when the shutter of the optical sensor unit is open.

Referring to FIGS. 13 and 14, a schematic structure of the optical sensor unit 150 viewed from the bottom thereof is described.

FIG. 13 shows the optical sensor unit 150 with the shutter 160 of the optical sensor unit 150 closed, and FIG. 14 shows the optical sensor unit 150 with the shutter 160 thereof open.

The shutter 160 shown in FIGS. 13 and 14 have two long holes 159 arranged in a predetermined interval in the longitudinal direction thereof. Each of the long holes 159 has a long opening, extending in a sliding direction of the shutter 160. The two long holes 159 are attached by respective screws 158 running therethrough. Accordingly, while being held by the holding member 156, the shutter 160 moves along the long openings of the respective long holes 159.

Figure 15:
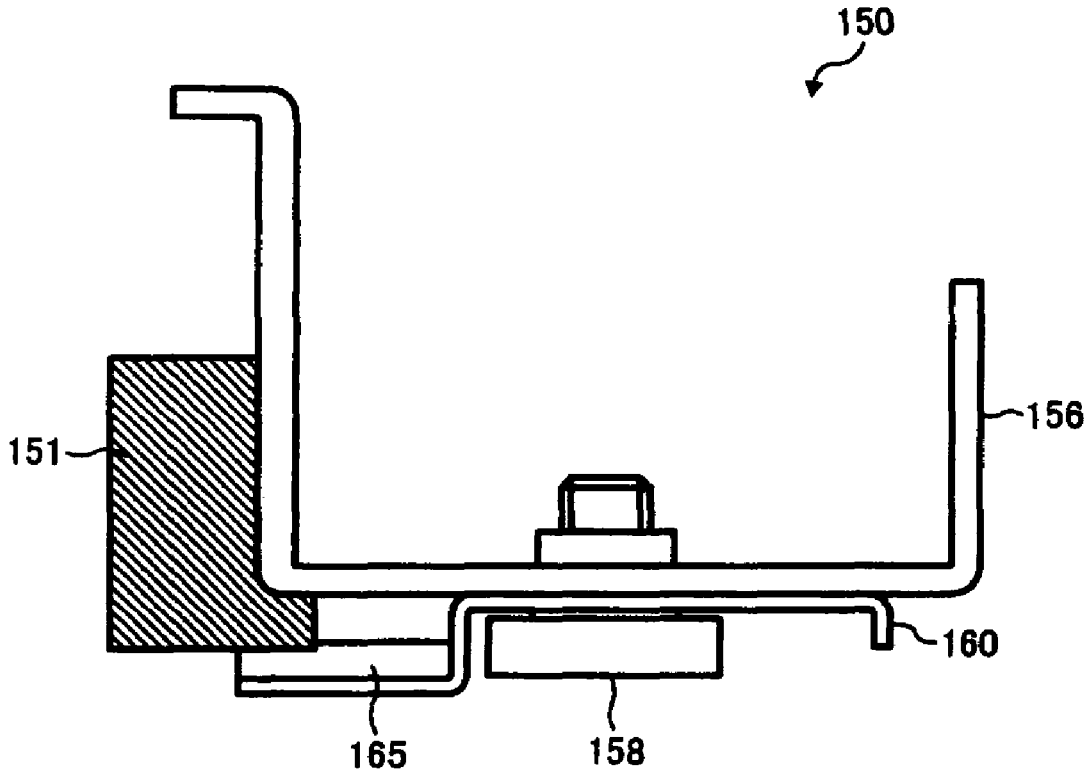
FIG. 15 is another cross sectional view of the optical sensor unit when the shutter of the optical sensor unit is open.

Referring to FIG. 15, a schematic structure of one non-limiting embodiment of the optical sensor unit 150 with the shutter 160 thereof open is described.

When the shutter 160 closed in FIG. 12 is moved from the left to the right, the shutter 160 is opened as shown in FIG. 15. Similarly, when the closed shutter 160 in FIG. 13 is moved in a direction as indicated by arrows in FIG. 13, the shutter 160 is opened as shown in FIG. 14 to expose respective light emitting and receiving windows W of the respective photosensors 151, 152, 153, 154*y*, 154*m*, 154*c*, and 154*bk*.

In the optical sensor unit 150 of the printer 100 according to the exemplary embodiment of the present invention, each of the respective light emitting and receiving windows W is formed in a united window. That is, the light emitting window and the light receiving window of the photosensor are formed in one unit. However, the present invention can incorporate light emitting windows and light receiving windows that are separately formed as individual units. Additionally, some windows may be combined in with other windows while some windows remain separate.

Figure 16:
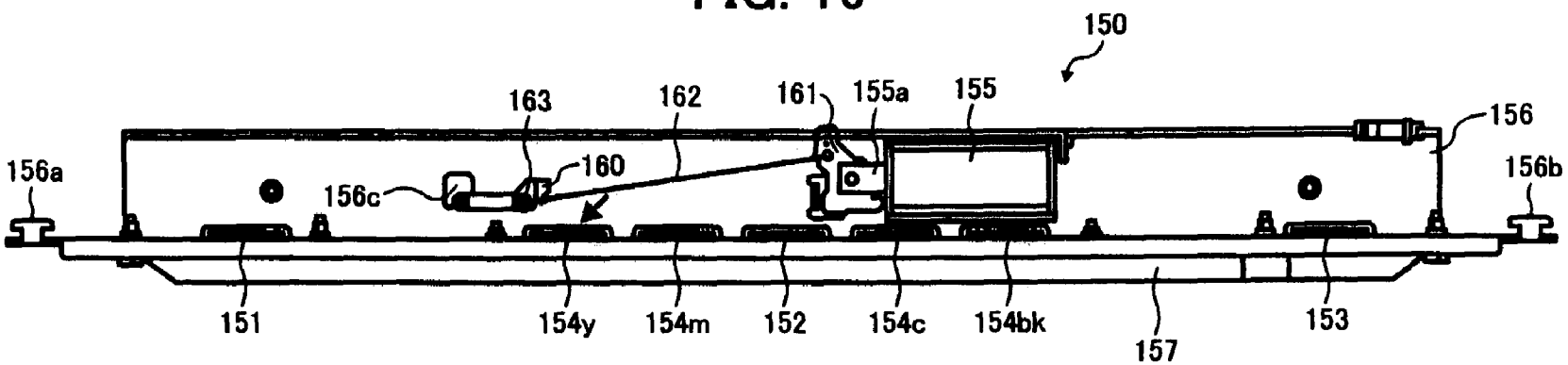
FIG. 16 is a plan view of the optical sensor unit viewed from the top thereof, when the shutter of the optical sensor unit is closed.
Figure 17:
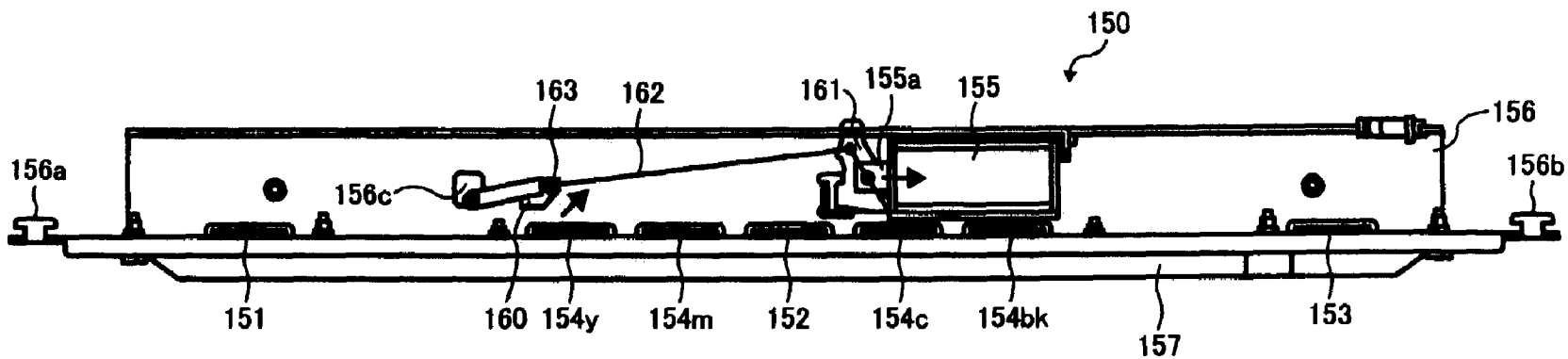
FIG. 17 is another plan view of the optical sensor unit viewed from the top thereof, when the shutter of the optical sensor unit is open.

Referring to FIGS. 16 and 17, a schematic structure of the optical sensor unit 150 viewed from the top thereof is described. FIG. 16 shows the optical sensor unit 150 with the shutter 160 thereof closed, and FIG. 17 shows the optical sensor unit 150 with the shutter 160 thereof open.

The holding member 156 includes the shutter solenoid 155 that is fixedly mounted on the bottom surface thereof. The shutter solenoid 155 is a drive source of the shutter 160, and includes an extendable shaft 155*a*. The extendable shaft 155*a* of the shutter solenoid 155 is mounted with a pivot arm 161 that is movable about a pivot shaft (not shown), both of which are concentrically supported by a pin that is punched therethrough.

The holding member 156 also includes a hook hole 156*c* formed on the bottom surface to run therethrough. The hook hole 156*c* is used to cause a hook 163 to pass therethrough. The hook 163 is formed on the back side of the shutter 160 in a protruding manner. The hook 163 passes through the hook hole 156*c* and protrudes from the bottom surface.

The holding member 156 further includes a wire 162 in the vicinity of the pivot arm 161 to connect the pivot arm 161 and the hook 163. More specifically, one end of the wire 162 is fixed to one end portion of the pivot arm 161 and the other end of the wire 162 is fixed to the hook 163.

When the shutter solenoid 155 shown in FIG. 16 is driven to pull the extendable shaft 155*a*, the driving force is transmitted to the pivot arm 161 via the pin. Due to the lever rule, the free end of the pivot arm 161 can angularly move about the pivot shaft more than the extendable shaft 155*a* by a predetermined angle. This action pulls the wire 162 to slide the shutter 160 in the upward direction so that the shutter 160 can be opened as shown in FIG. 17. Accordingly, to transmit the driving force exerted by the extendable shaft 155*a* of the shutter solenoid 155 to the shutter 160, the printer 100 uses the pivot arm 161 that may increase the amount of elasticity of the extendable shaft 155*a* to transmit to the shutter 160.

As previously described with reference to FIG. 3, the secondary transfer bias roller 19 is fixedly mounted to the cover 60. Further, respective toner images formed on the plurality of photoconductive drums 1*y*, 1*m*, 1*c*, and 1*bk* are sequentially transferred onto the intermediate transfer belt 8 as a color toner image. When a transfer sheet is conveyed between the intermediate transfer belt 8 and the secondary transfer bias roller 19, the color toner image is transferred onto the transfer sheet.

With the above-described structure, when the cover 60 is opened, the secondary transfer bias roller 19 is separated from the intermediate transfer belt 8 so that the sheet conveying path can be exposed.

Though not shown in FIG. 16, the opening H of the housing 50 is located below the sensor cover 157 that covers the above-described seven photosensors 151, 152, 153, 154*y*, 154*m*, 154*c*, and 154*bk*. Therefore, the shutter solenoid 155 is fixed to the holding member 156 that causes the photosensors 151, 152, 153, 154*y*, 154*m*, 154*c*, and 154*bk* to reside between the opening H and the holding member 156.

Since the shutter solenoid 155 is disposed farther than the seven photosensors 151, 152, 153, 154*y*, 154*m*, 154*c*, and 154*bk* from the opening H, a printer 100 having the above-described structure can prevent the shutter solenoid 155 from protruding to the outside of the printer 100, which can prevent the transfer sheet from being stopped due to a blockage of the sheet conveying path.

The printer 100 according to the exemplary embodiment of the present invention uses the photosensors 151, 152, 153, 154*y*, 154*m*, 154*c*, and 154*bk* serving as optical sensors that detect the amount of light reflected from the surface of the intermediate transfer belt serving as a loop-shaped endless moving member. However, the photosensors 151, 152, 153, 154*y*, 154*m*, 154*c*, and 154*bk* are not limited to the reflective-type photosensors. The present invention can apply a photosensor that can detect the amount of light transmitted through the intermediate transfer belt 8.

The printer 100 according to the exemplary embodiment of the present invention also uses the intermediate transfer belt 8 so that a toner image formed on each of the photoconductive drums 1*y*, 1*m*, 1*c*, and 1*bk* can indirectly be transferred onto a transfer sheet. However, the image transfer method is not limited to the indirect transfer method. The present invention can apply a direct image transfer method in which respective toner images formed on the photoconductive drums 1*y*, 1*m*, 1*c*, and 1*bk* are directly transferred onto a transfer sheet. In this case, the printer 100 employing the direct image transfer method can be controlled to transfer the respective reference toner images formed on the photoconductive drums 1*y*, 1*m*, 1*c*, and 1*bk* onto a transfer sheet that is carried by an endless moving member when adjusting the image forming ability and registration skew.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

Obviously, numerous modifications and variations of the present invention are possible in light of the above teachings. It is therefore to be understood that within the scope of the appended claims, the invention may be practiced otherwise than as specifically described herein.

The invention claimed is:

1. An image forming apparatus, comprising:

a housing including a cover configured to cover an opening provided in the housing;

a transfer unit configured to move a loop-shaped moving member so that a toner image transferred by the transfer unit is conveyed, a portion of the loop-shaped moving member, across an entire width in a direction perpendicular to a moving direction thereof, being exposed through the opening when the cover is opened; and a sensor unit including a holding member configured to hold a plurality of optical sensors arranged in a direction perpendicular to the moving direction of the loop-shaped moving member, the plurality of optical sensors configured to detect respective amounts of light at respective areas different from each other on the loop-shaped moving member, end portions of the sensor unit along the arrangement of the plurality of optical sensors being fixed in the housing at end portions of the opening in a widthwise direction perpendicular to the moving direction of the loop-shaped moving member.

2. The image forming apparatus according to claim 1, further comprising:

a plurality of image bearing members configured to bear respective toner images thereon; and a calculating unit configured to calculate a value of a variable based on respective results detected by the plurality of optical sensors.

3. The image forming apparatus according to claim 2, wherein the transfer unit is configured to move the loop-shaped moving member sequentially facing the plurality of image bearing members so that the respective toner images formed on the plurality of image bearing members are transferred onto a recording medium in one of a direct manner and an indirect manner via the loop-shaped moving member, and the housing is configured to include the plurality of image bearing members, the transfer unit, the sensor unit, and the calculating unit.

4. The image forming apparatus according to claim 3, wherein the calculating unit is configured to calculate an amount of image skew as the variable, based on each of the respective detection results, the image skew being formed in a direction perpendicular to the moving direction of the loop-shaped moving member with respect to the plurality of toner images transferred onto the loop-shaped moving member.

5. The image forming apparatus according to claim 3, wherein the calculating unit is configured to calculate an amount of image shift as the variable, based on each of the respective detection results, the image shift being formed in the moving direction of the loop-shaped moving member with respect to the plurality of toner images transferred onto the loop-shaped moving member.

6. The image forming apparatus according to claim 3, wherein the calculating unit is configured to calculate an amount of attached toner per unit area as the variable, based on each of the respective detection results.

7. The image forming apparatus according to claim 3, wherein the housing includes first and second fixing members, and the first fixing member fixes a surface thereof facing the opening of the housing, with one end portion of the holding member in a direction perpendicular to the moving direction of the loop-shaped moving member, and the second fixing member fixes a surface thereof facing the opening of the housing, with another end portion of the holding member.

8. The image forming apparatus according to claim 7, wherein the opening and surfaces of the first and second fixing members respectively extend in a vertical direction.

9. The image forming apparatus according to claim 8, wherein the holding member comprises:

a first engaging member configured to engage a portion thereof with an upper portion of the first fixing member in the vertical direction of the first fixing member so that the one end portion of the holding member is temporarily engaged between the opening and the surface of the first fixing member facing the opening; and a second engaging member configured to engage a portion thereof with an upper portion of the second fixing member in the vertical direction of the second fixing member so that the other end portion of the holding member is temporarily engaged between the opening and the surface of the second fixing member facing the opening.

10. The image forming apparatus according to claim 9, wherein the sensor unit is arranged in a vertical direction at a position above the loop-shaped moving member.

11. The image forming apparatus according to claim 9, wherein the holding member includes first and second sides of a side plane surface thereof; and the first and second fixing members are fixed in close contact with the first side to mount the plurality of optical sensors thereon, and the plurality of optical sensors are mounted on the second side opposite to the first side thereof.

12. The image forming apparatus according to claim 3, wherein the plurality of optical sensors are configured to detect one of an amount of light reflected from the surface of the loop-shaped moving member and an amount of light transmitted through the loop-shaped moving member, by emitting and receiving through at least one window; and the holding member includes a shutter configured to open and close the at least one window; and a drive source configured to drive the shutter.

13. The image forming apparatus according to claim 12, wherein the cover is configured to fixedly mount a roller configured to rotate while contacting the loop-shaped moving member;

the recording medium is conveyed between the loop-shaped moving member and the roller; and the holding member is configured to hold the plurality of optical sensors between the opening and the drive source and fixedly mount the drive source thereon.

14. An image forming apparatus, comprising:

a housing including means for covering an opening provided in the housing;

means for moving means for conveying so that a toner image transferred by the means for conveying is conveyed, a portion of the means for conveying in an entire widthwise direction perpendicular to a moving direction thereof being exposed through the opening when the means for covering is opened; and means for holding means for sensing respective amounts of light at respective areas different from each other on the means for conveying, end portions of the means for holding along the arrangement of the means for sensing being fixed at end portions of the opening in a widthwise direction perpendicular to the moving direction of the means for conveying.

15. The image forming apparatus according to claim 14, wherein the housing includes first and second means for fixing respective surfaces thereof with the means for holding, and the respective surfaces of the first and second means for fixing face the opening of the housing.

16. The image forming apparatus according to claim 15, wherein the means for holding comprises:

first means for engaging with the first means for fixing; and second means for engaging with the second means for fixing so that the means for holding member is temporarily engaged with the housing.

17. The image forming apparatus according to claim 14, wherein the means for sensing detect one of an amount of light reflected from the means for conveying and an amount of light transmitted through the means for conveying, by emitting and receiving through at least one window; and the means for holding comprises:

means for opening and closing the at least one window; and means for driving the means for opening and closing.

18. The image forming apparatus according to claim 17, wherein the means for covering includes a roller contacting the means for conveying when the means for covering is closed and separating from the means for conveying when the means for covering is opened.

19. A method of disposing a plurality of optical sensors in a housing of an image forming apparatus, comprising:

forming an opening in the housing extending across an entire width of the housing, in a direction perpendicular to a moving direction of a loop-shaped moving member;

providing first and second fixing members in the housing;

mounting first and second engaging members on a holding member holding the plurality of optical sensors thereon;

temporarily engaging the first and second engaging members with the first and second fixing members, respectively; and positioning the holding member within the housing such that the engaging members are fixed in the housing at end portions of the opening in a widthwise direction perpendicular to the moving direction of the loop-shaped moving member.

20. The method according to claim 19, further comprising:

mounting a shutter on the holding member to open and close at least one window for emitting and receiving light therethrough so that the plurality of optical sensors detect one of an amount of light reflected from a surface of the loop-shaped moving member and an amount of light transmitted through the loop-shaped moving member.

* * * * *